US012195947B2

(12) United States Patent
Ueda et al.

(10) Patent No.: US 12,195,947 B2
(45) Date of Patent: Jan. 14, 2025

(54) WORKING MACHINE

(71) Applicant: KUBOTA CORPORATION, Osaka (JP)

(72) Inventors: Kazuki Ueda, Osaka (JP); Keisuke Naito, Osaka (JP); Ryota Hamamoto, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 284 days.

(21) Appl. No.: 18/074,741

(22) Filed: Dec. 5, 2022

(65) Prior Publication Data

US 2023/0203782 A1 Jun. 29, 2023

(30) Foreign Application Priority Data

Dec. 28, 2021 (JP) ..... 2021-213680

(51) Int. Cl.
*E02F 9/20* (2006.01)
*E02F 9/22* (2006.01)

(52) U.S. Cl.
CPC ..... *E02F 9/2025* (2013.01); *E02F 9/2203* (2013.01); *E02F 9/2267* (2013.01); *E02F 9/2292* (2013.01)

(58) Field of Classification Search
CPC ..... E02F 9/2025; E02F 9/2203; E02F 9/2267; E02F 9/2292; G05D 13/00; G05D 2105/05
See application file for complete search history.

(56) References Cited

U.S. PATENT DOCUMENTS

2020/0263393 A1 8/2020 Fukuda et al.
2021/0062912 A1* 3/2021 Knutson ..... E02F 9/2253
2021/0123212 A1* 4/2021 Toyama ..... E02F 9/225

FOREIGN PATENT DOCUMENTS

JP 2020133469 8/2020

* cited by examiner

*Primary Examiner* — Aaron L Troost
(74) *Attorney, Agent, or Firm* — GREENBLUM & BERNSTEIN, P.L.C.

(57) ABSTRACT

A working machine includes first and second traveling pumps, an acquirer to acquire the number of revolutions and the rotation direction of each of first and second traveling motors, a determiner to, based on the acquired number of revolutions and the acquired rotation direction, determine whether a machine body is in a straight traveling state or a turn traveling state, and a controller configured or programmed to, when switching from a first state allowing rotation speeds of the first and second traveling motors to increase up to a first maximum speed, to a second state allowing the rotation speeds to increase up to a second maximum speed higher than the first maximum speed, or vice versa, is performed, reduce an amount of hydraulic fluid supply from the pumps to the motors according to the straight traveling state or the turn traveling state of the machine body.

20 Claims, 18 Drawing Sheets

<Control map showing motor revolutions and gain percentage>

| Traveling state | Motor rev. [rpm] | Gain percentage [%] |
|---|---|---|
| Straight traveling | 50 | 0 |
| | 100 | 40 |
| | 150 | 80 |
| | 200 | 100 |
| Pivot turn | 50 | 0 |
| | 100 | 20 |
| | 150 | 40 |
| | 200 | 60 |
| Spin turn | 50 | 0 |
| | 100 | 10 |
| | 150 | 20 |
| | 200 | 30 |
| Large turn | 50 | 0 |
| | 100 | 30 |
| | 150 | 60 |
| | 200 | 80 |
| Small turn | 50 | 0 |
| | 100 | 20 |
| | 150 | 30 |
| | 200 | 40 |

Fig.3C

<Control map showing motor revolutions and gain percentage>

| Traveling state | Motor rev. [rpm] | Gain percentage [%] |
|---|---|---|
| Straight traveling | 50 | 0 |
| | 100 | 40 |
| | 150 | 80 |
| | 200 | 100 |
| Pivot turn | 50 | 0 |
| | 100 | 20 |
| | 150 | 40 |
| | 200 | 60 |
| Spin turn | 50 | 0 |
| | 100 | 10 |
| | 150 | 20 |
| | 200 | 30 |
| Large turn | 50 | 0 |
| | 100 | 30 |
| | 150 | 60 |
| | 200 | 80 |
| Small turn | 50 | 0 |
| | 100 | 20 |
| | 150 | 30 |
| | 200 | 40 |

| Traveling state | Vehicle speed | Parameter map | | | | |
|---|---|---|---|---|---|---|
| | | a: Reduction amount | b: Reduction rate | c: Delay time | d: Return rate | e: Time before starting to return |
| Straight traveling | V1 | a1 | b1 | c1 | d1 | e1 |
| Pivot turn | V1 | a3 | b3 | c3 | d3 | e3 |
| Spin turn | V1 | a5 | b5 | c5 | d5 | e5 |

Fig.11

WORKING MACHINE

CROSS REFERENCE TO RELATED APPLICATIONS

This application claims the benefit of priority to Japanese Patent Application No. 2021-213680 filed on Dec. 28, 2021. The entire contents of this application are hereby incorporated herein by reference.

BACKGROUND OF THE INVENTION

1. Field of the Invention

The present disclosure relates to a working machine such as, for example, a skid-steer loader, a compact track loader, or a backhoe.

2. Description of the Related Art

A technique for reducing a shift shock caused during shift-down operation and shift-up operation of a working machine, as an example of related art, is disclosed in Japanese Unexamined Patent Application Publication No. 2020-133469. A hydraulic system of the working machine disclosed in this related-art publication includes a prime mover, traveling pumps configured to operate by power of the prime mover and deliver a hydraulic fluid, traveling motors capable of rotating using the hydraulic fluid delivered by the traveling pumps, a machine body in which the traveling pumps and the traveling motors are provided, a traveling detector capable of detecting a traveling speed of the machine body, a traveling switching valve switchable between a first state, in which rotation speeds of the traveling motors are able to be increased up to a first maximum or utmost speed, and a second state, in which the rotation speeds of the traveling motors are able to be increased up to a second maximum or utmost speed higher than the first maximum or utmost speed, and a controller configured to set an amount of reduction in the number of revolutions of the prime mover corresponding to the traveling speed of the machine body detected by the traveling detector and reduce the number of revolutions of the prime mover based on the set amount of reduction when shift-up switching from the first state to the second state or shift-down switching from the second state to the first state is performed. With this configuration, the related-art system reduces a shift shock caused during shift-down operation and shift-up operation.

SUMMARY OF THE INVENTION

In the working machine disclosed in the above publication, the only thing that is done when its speed stage is shifted down and when shifted up is to set the amount of reduction in the number of revolutions of the prime mover according to the traveling speed of the machine body; therefore, it is difficult to reduce a shift shock appropriately when the machine body is in a turn traveling state. In addition, in the working machine disclosed in the above publication, it is difficult to determine whether the machine body 2 is in a straight traveling state or a turn traveling state accurately. Therefore, in the working machine disclosed in the above publication, it is difficult to reduce a shift shock appropriately depending on whether the machine body 2 is in a straight traveling state or a turn traveling state.

Preferred embodiments of the present invention provide hydraulic systems for working machine machines capable of reducing a shift shock appropriately when in a straight traveling state and when in a turn traveling state.

Preferred embodiments of the present invention provide the technical solutions as follows.

A working machine according to an aspect of the present disclosure includes: a prime mover; a machine body in which the prime mover is provided; a left traveling device provided on a left side of the machine body; a right traveling device provided on a right side of the machine body; a left traveling pump operable by power of the prime mover to deliver a hydraulic fluid; a right traveling pump operable by power of the prime mover to deliver a hydraulic fluid; a left traveling motor to rotate in a normal or reverse direction with the hydraulic fluid delivered by the left traveling pump, and to transmit power to the left traveling device; a right traveling motor to rotate in a normal or reverse direction with the hydraulic fluid delivered by the right traveling pump, and to transmit power to the right traveling device; an acquirer to acquire a number of revolutions and a rotation direction of each of the left traveling motor and the right traveling motor; a determiner to, based on the acquired number of revolutions and the acquired rotation direction of each of the left traveling motor and the right traveling motor, determine whether the machine body is in a straight traveling state or in a turn traveling state; a traveling switching valve to switch between a first state allowing a rotation speed of the left traveling motor and a rotation speed of the right traveling motor to increase up to a first maximum or utmost speed, and a second state allowing the rotation speed of the left traveling motor and the rotation speed of the right traveling motor to increase up to a second maximum or utmost speed higher than the first maximum or utmost speed; a traveling manipulator including an operation valve to change hydraulic fluid pressure acting on the left traveling pump and the right traveling pump in response to operation of an operation member; and a controller configured or programmed to reduce an amount of hydraulic fluid supply from the left traveling pump and the right traveling pump to the left traveling motor and the right traveling motor according to the straight traveling state or the turn traveling state of the machine body in a case of switching from the first state to the second state or switching from the second state to the first state.

The controller may be configured or programmed to perform shift shock reduction control of reducing the amount of hydraulic fluid supply to the left traveling motor and the right traveling motor by reducing traveling pilot pressure, which is hydraulic fluid pressure acting on the left traveling pump and the right traveling pump, according to the straight traveling state or the turn traveling state of the machine body in the case of switching from the first state to the second state or switching from the second state to the first state.

The controller may be configured or programmed to perform shift shock reduction control of reducing a number of revolutions of the prime mover by outputting, to the prime mover, a control signal in which an amount of reduction in the number of revolutions of the prime mover is set, according to the straight traveling state or the turn traveling state of the machine body in the case of switching from the first state to the second state or switching from the second state to the first state.

The determiner may be configured or programmed to determine a pivot turn and a spin turn in the turn traveling state. The determiner may be configured to or programmed (i) determine that the machine body is in the straight traveling state in a case where the rotation direction of the left traveling motor is same as the rotation direction of the right traveling motor and, in addition, where a difference in the number of revolutions between the left traveling motor and the right traveling motor is zero or is less than a first difference, (ii) determine that the machine body is making the pivot turn in a case where either the left traveling motor only or the right traveling motor only is rotating, and (iii) determine that the machine body is making the spin turn in a case where the rotation direction of the left traveling motor and the rotation direction of the right traveling motor are opposite of each other and, in addition, where the difference in the number of revolutions between the left traveling motor and the right traveling motor is zero or is less than the first difference. The controller may be configured or programmed to reduce the amount of hydraulic fluid supply to the left traveling motor and the right traveling motor by reducing the traveling pilot pressure according to the straight traveling state, the pivot turn, and the spin turn of the machine body.

The determiner may be configured or programmed to determine a large turn and a small turn in the turn traveling state. The determiner may be configured or programmed to (iv) determine that the machine body is making the large turn in a case where the rotation direction of the left traveling motor is same as the rotation direction of the right traveling motor and, in addition, where a difference in the number of revolutions between the left traveling motor and the right traveling motor is greater than the first difference, and (v) determine that the machine body is making the small turn in a case where the rotation direction of the left traveling motor and the rotation direction of the right traveling motor are opposite of each other and, in addition, where the difference in the number of revolutions between the left traveling motor and the right traveling motor is greater than the first difference. The controller may be configured or programmed to reduce the amount of hydraulic fluid supply to the left traveling motor and the right traveling motor by reducing the traveling pilot pressure according to the large turn and the small turn of the machine body.

The controller may be configured or programmed to set an amount of reduction in the traveling pilot pressure in such a way as to become smaller in an order of the straight traveling state, the large turn, the pivot turn, the small turn, and the spin turn.

The controller may have a control map in which, for each of the straight traveling state and the turn traveling state, an amount of reduction in the traveling pilot pressure has been set in advance for each of a plurality of number-of-revolutions segments obtained by performing multiple-range segmentation of the number of revolutions of the left traveling motor and the number of revolutions of the right traveling motor.

The determiner may be configured or programmed to determine a pivot turn and a spin turn in the turn traveling state. The determiner may be configured or programmed to (i) determine that the machine body is in the straight traveling state in a case where the rotation direction of the left traveling motor is same as the rotation direction of the right traveling motor and, in addition, where a difference in the number of revolutions between the left traveling motor and the right traveling motor is zero or is less than a first difference, (ii) determine that the machine body is making the pivot turn in a case where either the left traveling motor only or the right traveling motor only is rotating, and (iii) determine that the machine body is making the spin turn in a case where the rotation direction of the left traveling motor and the rotation direction of the right traveling motor are opposite of each other and, in addition, where the difference in the number of revolutions between the left traveling motor and the right traveling motor is zero or is less than the first difference. The controller may be configured or programmed to set the amount of reduction in the number of revolutions of the prime mover according to the straight traveling state, the pivot turn, and the spin turn of the machine body.

The determiner may be configured or programmed to determine a large turn and a small turn in the turn traveling state. The determiner may be configured to (iv) determine that the machine body is making the large turn in a case where the rotation direction of the left traveling motor is same as the rotation direction of the right traveling motor and, in addition, where a difference in the number of revolutions between the left traveling motor and the right traveling motor is greater than the first difference, and (v) determine that the machine body is making the small turn in a case where the rotation direction of the left traveling motor and the rotation direction of the right traveling motor are opposite of each other and, in addition, where the difference in the number of revolutions between the left traveling motor and the right traveling motor is greater than the first difference. The controller may be configured to set the amount of reduction in the number of revolutions of the prime mover according to the large turn and the small turn of the machine body.

The controller may be configured or programmed to set the amount of reduction in the number of revolutions of the prime mover in such a way as to become smaller in an order of the straight traveling state, the large turn, the pivot turn, the small turn, and the spin turn.

The controller may have a control map in which, for each of the straight traveling state and the turn traveling state, the amount of reduction in the number of revolutions of the prime mover has been set in advance for each of a plurality of number-of-revolutions segments obtained by performing multiple-range segmentation of the number of revolutions of the left traveling motor and the number of revolutions of the right traveling motor.

The acquirer may be a rotation detection sensor configured to detect the number of revolutions and the rotation direction of each of the left traveling motor and the right traveling motor.

The acquirer may include a number-of-revolutions detection sensor configured to detect the number of revolutions of each of the left traveling motor and the right traveling motor and an operation direction detection sensor configured to detect an operation direction of the operation member. The determiner may be configured to, based on the detected operation direction of the operation member, determine whether the machine body is in the straight traveling state or in the turn traveling state.

The working machine may include a mode selector configured to select a manual shift mode or an automatic shift mode, and the controller may set a diminution of reducing an amount of supply to the operation valve in the automatic shift mode to be greater than a diminution of reducing the amount of supply in the manual shift mode.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

FIG. 3C is a diagram illustrating a control map showing a relationship between motor revolutions and gain percentage for each of a straight traveling state and a turn traveling state.

FIG. 11 is a table of a parameter map according to a modification example.

DETAILED DESCRIPTION OF THE PREFERRED EMBODIMENTS

Figure 1:
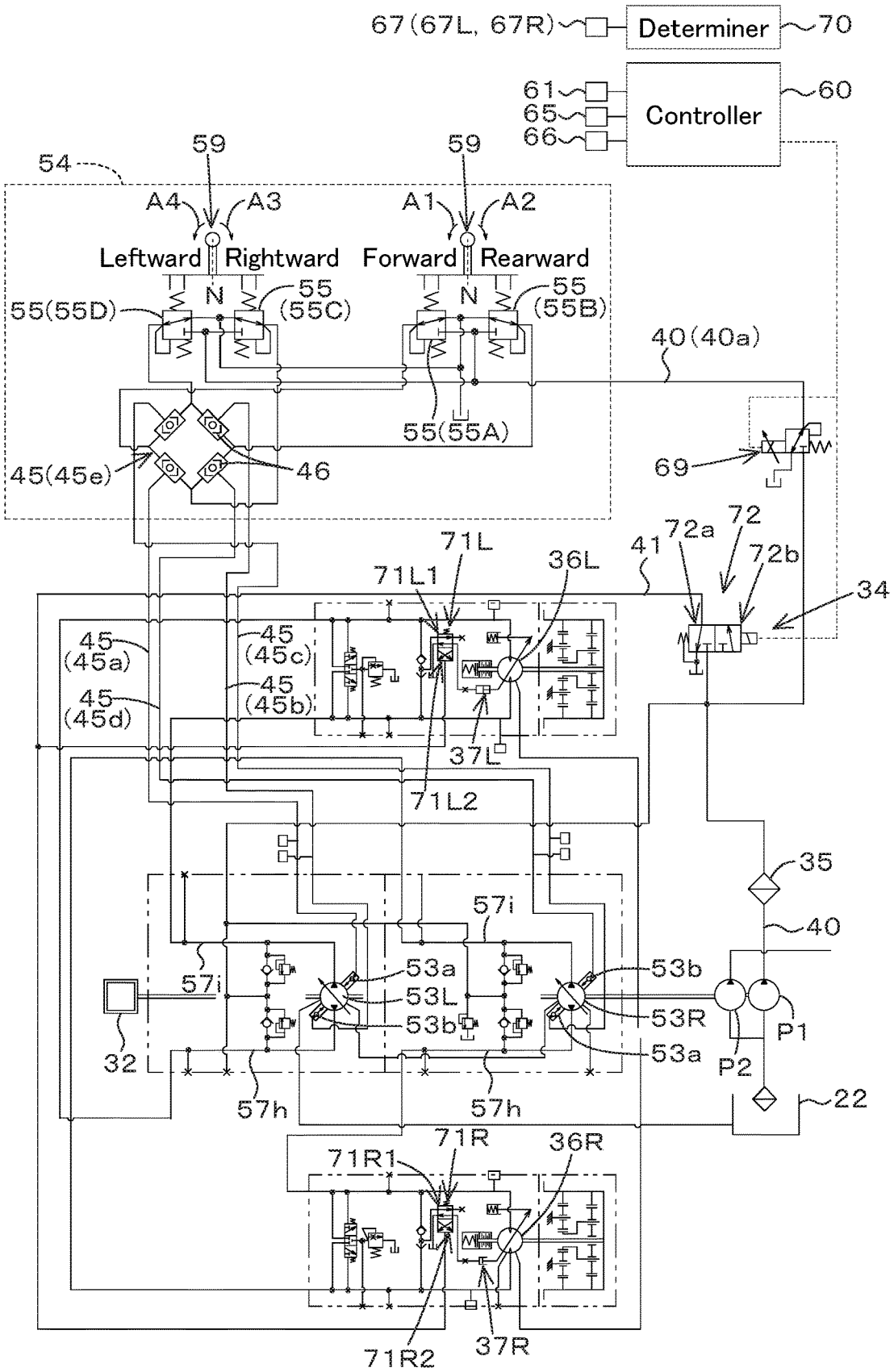
FIG. 1 is a diagram illustrating a hydraulic system (hydraulic circuit) of a working machine according to a first preferred embodiment.

The preferred embodiments will now be described with reference to the accompanying drawings, wherein like reference numerals designate corresponding or identical elements throughout the various drawings. The drawings are to be viewed in an orientation in which the reference numerals are viewed correctly.

A working machine, and a hydraulic system of the working machine, according some preferred embodiments of the present disclosure will now be described while referring to the drawings, where necessary.

First Preferred Embodiment

Figure 14:
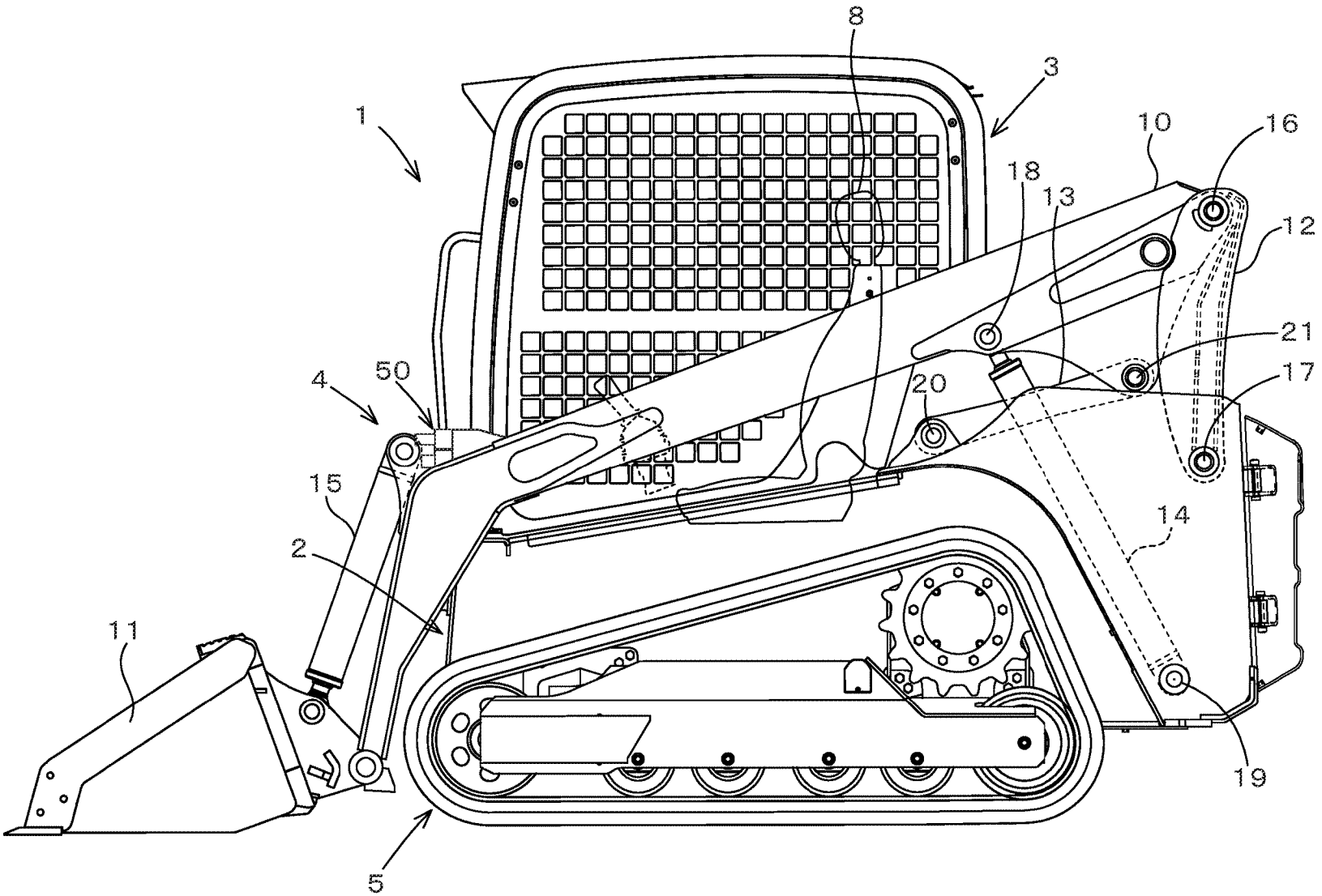
FIG. 14 is a side view of a track loader that is an example of the working machine.

FIG. 14 is a side view of an example of a working machine according to the present disclosure. In FIG. 14, a compact track loader is illustrated as an example of a working machine. However, the working machine according to the present disclosure is not limited to a compact track loader. It may be any other kind of loader machine such as, for example, a skid-steer loader. It may be any kind of working machine other than a loader machine.

As illustrated in FIG. 14, the working machine 1 includes a machine body 2, a cabin 3, a working device 4, and traveling devices 5. In a first preferred embodiment of the present disclosure, the term "forward" will be used for referring to a direction which an operator seated on an operator's seat 8 of the working machine 1 faces (leftward in FIG. 14), and the term "rearward" will be used for referring to the opposite direction thereof (rightward in FIG. 14). The term "leftward" will be used for referring to a direction going toward the left side as viewed from the operator (direction toward the near side in FIG. 14), and the term "rightward" will be used for referring to a direction going toward the right side as viewed from the operator (direction toward the far side in FIG. 14). A horizontal direction orthogonal to a front-rear direction will be referred to as "machine-body width direction". A direction going rightward or leftward from the center of the machine body 2 will be referred to as "machine-body outward direction". In other words, the machine-body outward direction is a direction going away from the machine body 2 as a kind of the machine-body width direction. The direction that is the opposite of the machine-body outward direction will be referred to as "machine-body inward direction". In other words, the machine-body inward direction is a direction going toward the machine body 2 as a kind of the machine-body width direction.

The cabin 3 is mounted on the machine body 2. The operator's seat 8 is provided inside the cabin 3. The working device 4 is mounted on the machine body 2. The traveling devices 5 are provided outside the machine body 2. A prime mover 32 is mounted on a rear portion inside the machine body 2.

The working device 4 includes booms 10, a bucket 11, which is an example of a working tool, lift links 12, control links 13, boom cylinders 14, and bucket cylinders 15.

The booms 10 are provided to the left and right of the cabin 3 respectively such that they can be moved pivotally up and down. The bucket 11 is provided on the distal end (front end) of the booms 10 such that it can be moved pivotally up and down. The lift links 12 and the control links 13 support the base (rear portion) of the booms 10 to enable pivotal up-and-down motion of the booms 10. The boom cylinders 14 raise and lower the booms 10 by their extending-and-retracting motion. The bucket cylinders 15 move the bucket 11 pivotally by their extending-and-retracting motion.

The front portion of the left boom 10 and the front portion of the right boom 10 are coupled to each other by a coupling pipe of a non-circular section. The bases (rear portion) of the booms 10 are coupled to each other by a coupling pipe of a circular section.

The lift links 12, the control links 13, and the boom cylinders 14 are provided on the left and right sides with respect to the machine body 2 respectively for the left and right booms 10.

The lift link 12 is provided in vertical orientation on the rear portion of the base of each of the booms 10. The top portion (one end) of each of the lift links 12 is pivotally supported on a pivot (for example, a first pivot shaft 16) near the rear end of the base of the corresponding one of the booms 10 in such a way as to be able to rotate on its horizontal axis. The bottom portion (the other end) of each of the lift links 12 is pivotally supported on a pivot (for example, a second pivot shaft 17) near the rear end of the machine body 2 in such a way as to be able to rotate on its horizontal axis. The second pivot shaft 17 is provided under the first pivot shaft 16.

The top portion of each of the boom cylinders 14 is pivotally supported on a pivot (for example, a third pivot shaft 18) in such a way as to be able to rotate on its horizontal axis. The third pivot shaft 18 is provided on the front portion of the base of each of the booms 10. The bottom portion of each of the boom cylinders 14 is pivotally supported on a pivot (for example, a fourth pivot shaft 19) in such a way as to be able to rotate on its horizontal axis. The fourth pivot shaft 19 is provided in the lower rear portion of the machine body 2 below the third pivot shaft 18.

The control links 13 are provided in front of the lift links 12. One end of each of the control links 13 is pivotally supported on a pivot (for example, a fifth pivot shaft 20) in such a way as to be able to rotate on its horizontal axis. The fifth pivot shaft 20 is provided on the machine body 2 in front of the lift links 12. The other end of each of the control links 13 is pivotally supported on a pivot (for example, a sixth pivot shaft 21) in such a way as to be able to rotate on its horizontal axis. The sixth pivot shaft 21 is provided on the booms 10 ahead of, and above, the second pivot shaft 17.

The extending-and-retracting motion of the boom cylinders 14 causes the booms 10 to move pivotally up and down around the first pivot shaft 16 while being supported at their base portion by the lift links 12 and the control links 13. The control links 13 move pivotally up and down around the fifth pivot shaft 20 when the booms 10 move pivotally up and down. The lift links 12 move pivotally forward and rearward around the second pivot shaft 17 when the control links 13 move pivotally up and down.

An alternative working tool can be attached to the front end of the booms 10 in place of the bucket 11. The alternative working tool is an attachment (auxiliary attachment) such as, for example, a hydraulic crusher, a hydraulic breaker, an angle broom, an earth auger, a pallet fork, a sweeper, a mower, or a snow blower.

A connection member 50 is provided on the front portion of the left boom 10. The connection member 50 is a device for connecting hydraulic equipment provided on the auxiliary attachment to a first conduit member such as a pipe provided on the boom 10. Specifically, the first conduit member can be connected to one end of the connection member 50, and a second conduit member connected to the hydraulic equipment of the auxiliary attachment can be connected to the other end thereof. The connection enables a hydraulic fluid flowing through the first conduit member to be supplied to the hydraulic equipment through the second conduit member.

The bucket cylinders 15 are disposed near the front portion of the booms 10 respectively. The extending-and-retracting motion of the bucket cylinders 15 causes pivotal motion of the bucket 11.

In the first preferred embodiment, a crawler-type (including semi-crawler-type) traveling system is adopted for each of the traveling device on the left side and the traveling device on the right side (left traveling device, right traveling device) 5. A wheeled-type traveling system including front and rear wheels may be adopted instead.

The prime mover 32 is an internal combustion engine such as a diesel engine or a gasoline engine, or an electric motor, etc. In the first preferred embodiment, the prime mover 32 is a diesel engine, but is not limited thereto.

Next, a hydraulic system of the working machine will now be explained.

As illustrated in FIG. 1, a hydraulic system of the working machine according to the first preferred embodiment is capable of driving the traveling devices 5 The hydraulic system of the working machine includes a first traveling pump 53L, a second traveling pump 53R, a first traveling motor 36L, and a second traveling motor 36R.

The first traveling pump 53L and the second traveling pump 53R are pumps configured to be driven by the power of the prime mover 32. Specifically, the first traveling pump 53L and the second traveling pump 53R are swash-plate variable displacement axial pumps configured to be driven by the power of the prime mover 32. Each of the first traveling pump 53L and the second traveling pump 53R includes a pressure receiver 53*a* and a pressure receiver 53*b* on which pilot pressure acts. The angle of its swash plate is changed by the pilot pressure acting on the pressure receiver 53*a*, 53*b*. It is possible to change the output (hydraulic fluid delivery amount) and hydraulic fluid delivery direction of the first, second traveling pump 53L, 53R by changing the angle of the swash plate.

The first traveling pump 53L is connected to the first traveling motor 36L through a circulation fluid passage 57*h*. A hydraulic fluid delivered by the first traveling pump 53L is supplied to the first traveling motor 36L. The second traveling pump 53R is connected to the second traveling motor 36R through a circulation fluid passage 57*i*. A hydraulic fluid delivered by the second traveling pump 53R is supplied to the second traveling motor 36R.

The first traveling motor 36L is a motor configured to transmit power to the drive shaft of the traveling device 5 provided on the left side of the machine body 2. The first traveling motor 36L is able to rotate using the hydraulic fluid delivered from the first traveling pump 53L. The rotation speed (number of revolutions) of the first traveling motor 36L can be changed by changing the flow rate of the hydraulic fluid. A swash plate switching cylinder 37L is connected to the first traveling motor 36L. The rotation speed (number of revolutions) of the first traveling motor 36L can be changed also by the extending-and-retracting motion of the swash plate switching cylinder 37L toward one side or the other side. Specifically, the number of revolutions of the first traveling motor 36L is set to LOW (a first speed range up to a first maximum or utmost speed; hereinafter simply referred to as "first speed", where appropriate) when the swash plate switching cylinder 37L is retracted. The number of revolutions of the first traveling motor 36L is set to HIGH (a second speed range up to a second maximum or utmost speed higher than the first maximum or utmost speed; hereinafter simply referred to as "second speed", where appropriate) when the swash plate switching cylinder 37L is extended. That is, the number of revolutions of the first traveling motor 36L is switchable between the first speed, which is LOW, and the second speed, which is HIGH.

The second traveling motor 36R is a motor configured to transmit power to the drive shaft of the traveling device 5 provided on the right side of the machine body 2. The second traveling motor 36R is able to rotate using the hydraulic fluid delivered from the second traveling pump 53R. The rotation speed (number of revolutions) of the second traveling motor 36R can be changed by changing the flow rate of the hydraulic fluid. A swash plate switching cylinder 37R is connected to the second traveling motor 36R. The rotation speed (number of revolutions) of the second traveling motor 36R can be changed also by the extending-and-retracting motion of the swash plate switching cylinder 37R toward one side or the other side. Specifically, the number of revolutions of the second traveling motor 36R is set to LOW (the first speed) when the swash plate switching cylinder 37R is retracted. The number of revolutions of the second traveling motor 36R is set to HIGH (the second speed) when the swash plate switching cylinder 37R is extended. That is, the number of revolutions of the second traveling motor 36R is switchable between the first speed, which is LOW, and the second speed, which is HIGH.

As illustrated in FIG. 1, the hydraulic system of the working machine includes a traveling switching valve 34. The traveling switching valve 34 is switchable between a first state, in which the rotation speeds (numbers of revolutions) of the traveling motors (the first traveling motor 36L and the second traveling motor 36R) can be increased up to the first maximum or utmost speed, and a second state, in which the rotation speeds (numbers of revolutions) of the traveling motors (the first traveling motor 36L and the second traveling motor 36R) can be increased up to the second maximum or utmost speed higher than the first maximum or utmost speed. The traveling switching valve 34 includes first switching valves 71L and 71R and a second switching valve 72.

The first switching valve 71L is connected to the swash plate switching cylinder 37L of the first traveling motor 36L through a fluid passage. The first switching valve 71L is a two-position switching valve switchable between a first position 71L1 and a second position 71L2. The swash plate switching cylinder 37L is retracted when the first switching valve 71L is put into the first position 71L1. The swash plate switching cylinder 37L is extended when the first switching valve 71L is put into the second position 71L2.

The first switching valve 71R is connected to the swash plate switching cylinder 37R of the second traveling motor 36R through a fluid passage. The second switching valve 71R is a two-position switching valve switchable between a first position 71R1 and a second position 71R2. The swash plate switching cylinder 37R is retracted when the first switching valve 71R is put into the first position 71R1. The swash plate switching cylinder 37R is extended when the first switching valve 71R is put into the second position 71R2.

The second switching valve 72 is a solenoid valve configured to switch the first switching valves 71L and 71R. The second switching valve 72 is a two-position switching valve switchable between a first position 72*a* and a second position 72*b* by energization. The second switching valve 72 is connected to the first switching valves 71L and 71R through a fluid passage 41. The second switching valve 72, when put into the first position 72*a*, switches the first switching valve 71L into the first position 71L1 and the first switching valve 71R into the first position 71R1. The second switching valve 72, when put into the second position 72*b*, switches the first switching valve 71L into the second position 71L2 and the first switching valve 71R into the second position 71R2.

That is, when the second switching valve 72 is in the first position 72*a*, the first switching valve 71L is in the first position 71L1, and the first switching valve 71R is in the first position 71R1, and, in this case, the traveling switching valve 34 is in the first state, and the rotation speed of the traveling motor (the first, second traveling motor 36L, 36R) is the first speed. When the second switching valve 72 is in the second position 72*b*, the first switching valve 71L is in the second position 71L2, and the first switching valve 71R is in the second position 71R2, and, in this case, the traveling switching valve 34 is in the second state, and the rotation speed of the traveling motor (the first, second traveling motor 36L, 36R) is the second speed.

Therefore, it is possible to switch the rotation speed of the traveling motor (the first, second traveling motor 36L, 36R) between the first speed, which is LOW, and the second speed, which is HIGH, by operating the traveling switching valve 34.

Switching between the first speed and the second speed of the traveling motor can be performed using a switcher. The switcher is, for example, a selector switch 61 connected to a controller 60 and operable by the operator. The switcher (selector switch 61) is able to perform shift-up/down switching. The shift-up switching is a shift from the first speed (first state) to the second speed (second state). The shift-down switching is a shift from the second speed (second state) to the first speed (first state).

As illustrated in FIG. 1, the hydraulic system of the working machine includes the controller 60. The controller 60 includes a semiconductor such as a CPU or an MPU, an electric/electronic circuit, etc. Based on switching operation of the selector switch 61, the controller 60 switches the traveling switching valve 34. The selector switch 61 is a push switch. For example, the selector switch 61, when pushed while the traveling motor is rotating at the first speed, outputs a command for switching the traveling motor to the second speed (a command for putting the traveling switching valve 34 into the second state) to the controller 60. The selector switch 61, when pushed while the traveling motor is rotating at the second speed, outputs a command for switching the traveling motor to the first speed (a command for putting the traveling switching valve 34 into the first state) to the controller 60. The selector switch 61 may be a push switch that can be held ON/OFF. The selector switch 61, when held OFF, outputs a command for keeping the traveling motor at the first speed. The selector switch 61, when held ON, outputs a command for keeping the traveling motor at the second speed.

The controller 60 puts the traveling switching valve 34 into the first state by de-energizing the solenoid of the second switching valve 72 when a command for putting the traveling switching valve 34 into the first state is acquired. The controller 60 puts the traveling switching valve 34 into the second state by energizing the solenoid of the second switching valve 72 when a command for putting the traveling switching valve 34 into the second state is acquired.

The hydraulic system of the working machine includes a first hydraulic pump P1, a second hydraulic pump P2, and a traveling manipulator 54. The first hydraulic pump P1 is a constant-displacement-type gear pump configured to be driven by the power of the prime mover 32. The first hydraulic pump P1 is capable of delivering a hydraulic fluid contained in a tank 22. More particularly, the first hydraulic pump P1 delivers a hydraulic fluid to be used mainly for control. For the sake of description, the tank 22 containing the hydraulic fluid may be referred to as "hydraulic fluid tank". Of the hydraulic fluid delivered from the first hydraulic pump P1, the hydraulic fluid to be used for control may be referred to as "pilot fluid", and the pressure of the pilot fluid may be referred to as "pilot pressure".

The second hydraulic pump P2 is a constant-displacement-type gear pump configured to be driven by the power of the prime mover 32. The second hydraulic pump P2 is capable of delivering the hydraulic fluid contained in the tank 22. For example, the second hydraulic pump P2 supplies the hydraulic fluid to work fluid passages. For example, the second hydraulic pump P2 supplies the hydraulic fluid to a plurality of control valves (flow rate control valves) to control the boom cylinders 14 for operating the booms 10, the bucket cylinders 15 for operating the bucket 11, and an auxiliary hydraulic actuator.

The traveling manipulator 54 is a device for manipulating the traveling pumps (the first traveling pump 53L and the second traveling pump 53R). The traveling manipulator 54 is able to change the angles of the swash plates of the traveling pumps (swash-plate angles). The traveling manipulator 54 includes an operation member 59 such as an operation lever and a plurality of operation valves 55.

The operation member 59 is an operation lever supported on the operation valves 55 and configured to be swung in the left-right direction (the machine-body width direction), the front-rear direction, or any oblique direction selectively. That is, when the neutral position N of the operation member 59 is defined as its home position, the operation member 59 can be operated rightward and leftward from the neutral position N, forward and rearward from the neutral position N, obliquely forward to the right, obliquely forward to the left, obliquely rearward to the left, and obliquely rearward to the right from the neutral position N. For the sake of description, the two directions going forward and rearward, namely, the front-rear direction, may be hereinafter referred to as "first direction". The two directions going rightward and leftward, namely, the left-right direction (the machine-body width direction), may be hereinafter referred to as "second direction".

The plurality of operation valves 55 is manipulated by operating the operation member 59 that is common to them, that is, a single operation member. The plurality of operation valves 55 operates based on the operator's swing motion of the operation member 59. A delivery fluid passage 40 is connected to the plurality of operation valves 55. The hydraulic fluid (pilot fluid) delivered from the first hydraulic pump P1 can be supplied to the plurality of operation valves 55 through the delivery fluid passage 40. The plurality of operation valves 55 includes an operation valve 55A, an operation valve 55B, an operation valve 55C, and an operation valve 55D.

When the operation member 59 is swung forward (operated forward) as one of the front-rear direction (first direction), the pressure of a hydraulic fluid which the operation valve 55A outputs changes in accordance with an amount of the forward operation. When the operation member 59 is swung rearward (operated rearward) as the other of the front-rear direction (first direction), the pressure of a hydraulic fluid which the operation valve 55B outputs changes in accordance with an amount of the rearward operation. When the operation member 59 is swung rightward (operated rightward) as one of the left-right direction (second direction), the pressure of a hydraulic fluid which the operation valve 55C outputs changes in accordance with an amount of the rightward operation. When the operation member 59 is swung leftward (operated leftward) as the other of the left-right direction (second direction), the pressure of a hydraulic fluid which the operation valve 55D outputs changes in accordance with an amount of the leftward operation.

The plurality of operation valves 55 is connected to the traveling pumps (the first traveling pump 53L and the second traveling pump 53R) through a traveling fluid passage 45. In other words, the traveling pump (the first, second traveling pump 53L, 53R) is hydraulic equipment that is operable using the hydraulic fluid outputted from the operation valve 55 (the operation valve 55A, 55B, 55C, 55D).

The traveling fluid passage 45 includes a first traveling fluid passage 45*a*, a second traveling fluid passage 45*b*, a third traveling fluid passage 45*c*, a fourth traveling fluid passage 45*d*, and a fifth traveling fluid passage 45*e*. The first traveling fluid passage 45*a* is a fluid passage connected to the pressure receiver 53*a* of the first traveling pump 53L. The second traveling fluid passage 45*b* is a fluid passage connected to the pressure receiver 53*b* of the first traveling pump 53L. The third traveling fluid passage 45*c* is a fluid passage connected to the pressure receiver 53*a* of the second traveling pump 53R. The fourth traveling fluid passage 45*d* is a fluid passage connected to the pressure receiver 53*b* of the second traveling pump 53R. The fifth traveling fluid passage 45*e* is a fluid passage for connection of the plurality of operation valves 55 to the first traveling fluid passage 45*a*, the second traveling fluid passage 45*b*, the third traveling fluid passage 45*c*, and the fourth traveling fluid passage 45*d*. The pressure at the traveling fluid passage 45 will be referred to as "traveling pilot pressure".

The traveling state of the working machine 1 (machine body 2) can be classified broadly into "a straight traveling state" and "a turn traveling state". The straight traveling state includes a forward straight traveling state and a rearward straight traveling state. The turn traveling state includes a spin turn, a small turn, a pivot turn, and a large turn in ascending order of their turning radii. For example, the turning radius of the spin turn is the smallest (e.g., zero) because the working machine 1 turns on the spot. In view of the turning radii, "a small turn" may be referred to as "a pivot-spin interim turn" or simply as "a steep turn", and "a large turn" may be referred to as "a straight-pivot interim turn" or simply as "a gradual turn" hereinafter.

Straight Forward Traveling

Figure 2:
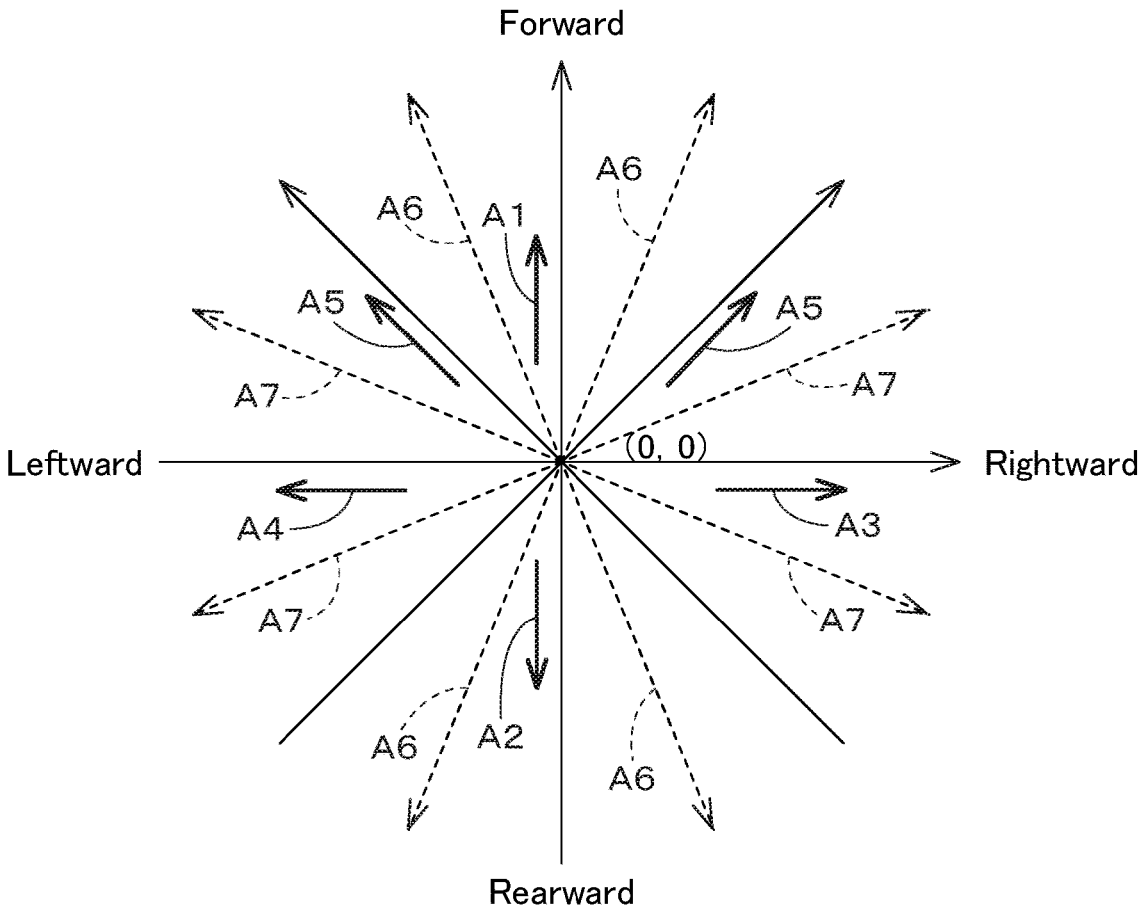
FIG. 2 is a diagram illustrating operation directions of an operation member.

When the operation member 59 is swung forward (in the direction indicated by an arrow A1 in FIGS. 1 and 2), the operation valve 55A is manipulated, and pilot pressure is outputted from the operation valve 55A. The pilot pressure acts on the pressure receiver 53*a* of the first traveling pump 53L through the first traveling fluid passage 45*a* and acts on the pressure receiver 53*a* of the second traveling pump 53R through the third traveling fluid passage 45*c*. This changes the swash-plate angles of the first traveling pump 53L and the second traveling pump 53R to cause the first traveling motor 36L and the second traveling motor 36R to rotate in the normal direction (forward rotation), thereby causing the working machine 1 to travel straight forward.

Straight Rearward Traveling

When the operation member 59 is swung rearward (in the direction indicated by an arrow A2 in FIGS. 1 and 2), the operation valve 55B is manipulated, and pilot pressure is outputted from the operation valve 55B. The pilot pressure acts on the pressure receiver 53*b* of the first traveling pump 53L through the second traveling fluid passage 45*b* and acts on the pressure receiver 53*b* of the second traveling pump 53R through the fourth traveling fluid passage 45*d*. This changes the swash-plate angles of the first traveling pump 53L and the second traveling pump 53R to cause the first traveling motor 36L and the second traveling motor 36R to rotate in the reverse direction (reverse rotation), thereby causing the working machine 1 to travel straight rearward.

Spin Turn

When the operation member 59 is swung rightward (in the direction indicated by an arrow A3 in FIGS. 1 and 2), the operation valve 55C is manipulated, and pilot pressure is outputted from the operation valve 55C. The pilot pressure acts on the pressure receiver 53*a* of the first traveling pump 53L through the first traveling fluid passage 45*a* and acts on the pressure receiver 53*b* of the second traveling pump 53R through the fourth traveling fluid passage 45*d*. This changes the swash-plate angles of the first traveling pump 53L and the second traveling pump 53R to cause the first traveling motor 36L to rotate in the normal direction and the second traveling motor 36R to rotate in the reverse direction, thereby causing the working machine 1 to make a spin turn to the right.

When the operation member 59 is swung leftward (in the direction indicated by an arrow A4 in FIGS. 1 and 2), the operation valve 55D is manipulated, and pilot pressure is outputted from the operation valve 55D. The pilot pressure acts on the pressure receiver 53*a* of the second traveling pump 53R through the third traveling fluid passage 45*c* and acts on the pressure receiver 53*b* of the first traveling pump 53L through the second traveling fluid passage 45*b*. This changes the swash-plate angles of the first traveling pump 53L and the second traveling pump 53R to cause the first traveling motor 36L to rotate in the reverse direction and the second traveling motor 36R to rotate in the normal direction, thereby causing the working machine 1 to make a spin turn to the left.

Pivot Turn

When the operation member 59 is swung in an oblique direction (in a direction indicated by an arrow A5 in FIG. 2), the rotation direction and the rotation speed of each of the first traveling motor 36L and the second traveling motor 36R are determined based on differential pressure between pilot pressure acting on the pressure receiver 53*a* and pilot pressure acting on the pressure receiver 53*b*, and the working machine 1 makes a pivot turn to the right or a pivot turn to the left while traveling forward or rearward.

Specifically, the working machine 1 turns as follows. When the operation member 59 is swung obliquely forward to the left, the working machine 1 makes a pivot turn to the left while traveling forward at a speed corresponding to the swing angle of the operation member 59. When the operation member 59 is swung obliquely forward to the right, the working machine 1 makes a pivot turn to the right while traveling forward at a speed corresponding to the swing angle of the operation member 59. When the operation member 59 is swung obliquely rearward to the left, the working machine 1 makes a pivot turn to the left while traveling rearward at a speed corresponding to the swing angle of the operation member 59. When the operation member 59 is swung obliquely rearward to the right, the working machine 1 makes a pivot turn to the right while traveling rearward at a speed corresponding to the swing angle of the operation member 59.

Large Turn

When the operation member 59 is swung in an oblique direction closer to the front-rear axis (in a direction indicated by an arrow A6 in FIG. 2), the rotation direction and the rotation speed of each of the first traveling motor 36L and the second traveling motor 36R are determined based on differential pressure between pilot pressure acting on the pressure receiver 53*a* and pilot pressure acting on the pressure receiver 53*b*, and the working machine 1 makes a large turn to the right or a large turn to the left while traveling forward or rearward.

Specifically, the working machine 1 turns as follows. When the operation member 59 is swung obliquely forward to the left in a direction closer to the front-rear axis, the working machine 1 makes a large turn to the left while traveling forward at a speed corresponding to the swing angle of the operation member 59. When the operation member 59 is swung obliquely forward to the right in a direction closer to the front-rear axis, the working machine 1 makes a large turn to the right while traveling forward at a speed corresponding to the swing angle of the operation member 59. When the operation member 59 is swung obliquely rearward to the left in a direction closer to the front-rear axis, the working machine 1 makes a large turn to the left while traveling rearward at a speed corresponding to the swing angle of the operation member 59. When the operation member 59 is swung obliquely rearward to the right in a direction closer to the front-rear axis, the working machine 1 makes a large turn to the right while traveling rearward at a speed corresponding to the swing angle of the operation member 59.

Small Turn

When the operation member 59 is swung in an oblique direction closer to the left-right axis (in a direction indicated by an arrow A7 in FIG. 2), the rotation direction and the rotation speed of each of the first traveling motor 36L and the second traveling motor 36R are determined based on differential pressure between pilot pressure acting on the pressure receiver 53*a* and pilot pressure acting on the pressure receiver 53*b*, and the working machine 1 makes a small turn to the right or a small turn to the left while traveling forward or rearward.

Specifically, the working machine 1 turns as follows. When the operation member 59 is swung obliquely forward to the left in a direction closer to the left-right-rear axis, the working machine 1 makes a small turn to the left while traveling forward at a speed corresponding to the swing angle of the operation member 59. When the operation member 59 is swung obliquely forward to the right in a direction closer to the left-right axis, the working machine 1 makes a small turn to the right while traveling forward at a speed corresponding to the swing angle of the operation member 59. When the operation member 59 is swung obliquely rearward to the left in a direction closer to the left-right axis, the working machine 1 makes a small turn to the left while traveling rearward at a speed corresponding to the swing angle of the operation member 59. When the operation member 59 is swung obliquely rearward to the right in a direction closer to the left-right axis, the working machine 1 makes a small turn to the right while traveling rearward at a speed corresponding to the swing angle of the operation member 59.

An accelerator 65 for setting a target number of revolutions of the prime mover 32 is connected to the controller 60. The accelerator 65 is provided near the operator's seat 8. The accelerator 65 is an accelerator lever supported pivotally, an accelerator pedal supported pivotally, an accelerator potentiometer supported rotatably, an accelerator slider supported slidably, or the like. The accelerator 65 is not limited to these examples. A revolution detector 66 for detecting an actual number of revolutions of the prime mover 32 is connected to the controller 60. Detection by the revolution detector 66 enables the controller 60 to obtain information on the actual number of revolutions of the prime mover 32. Based on an operation amount of the accelerator 65, the controller 60 sets the target number of revolutions and controls the actual number of revolutions to make it equal to the set target number of revolutions.

When the traveling switching valve 34 is switched from the first state to the second state and when the traveling switching valve 34 is switched from the second state to the first state, that is, when the rotation speed of the traveling motor is increased from the first speed to the second speed and when the rotation speed of the traveling motor is decreased from the second speed to the first speed, the controller 60 performs shift shock reduction control of reducing an amount of hydraulic fluid supply from the first traveling pump 53L and the second traveling pump 53R to the first traveling motor 36L and the second traveling motor 36R according to a straight traveling state or a turn traveling state of the machine body 2.

Specifically, when the valve state is switched from the first state to the second state or from the second state to the first state, the controller 60 outputs, to an actuation valve 69, a control signal specifying an amount of reduction in opening of the actuation valve 69 according to a straight traveling state or a turn traveling state of the machine body 2, to reduce the opening of the actuation valve 69, thereby performing shift shock reduction control of reducing an amount of hydraulic fluid supply from the first traveling pump 53L and the second traveling pump 53R to the first traveling motor 36L and the second traveling motor 36R.

As illustrated in FIG. 1, the controller 60 reduces a shift shock by controlling the opening of the actuation valve 69 according to a straight traveling state or a turn traveling state of the machine body 2. The actuation valve 69 is connected on the "after-branching" delivery fluid passage 40 in an interval 40*a* leading to the traveling manipulator 54, namely, upstream of the operation valves 55. The actuation valve 69 may be connected on the traveling fluid passage 45 downstream of the operation valves 55.

The actuation valve 69 is a proportional solenoid valve (proportional valve). Its opening can be changed by means of a control signal outputted from the controller 60. The control signal is, for example, a voltage or a current, etc. The actuation valve 69 is a valve whose opening increases as the control signal (voltage, current) outputted from the controller 60 increases and whose opening decreases as the control signal (voltage, current) outputted from the controller 60 decreases.

That is, in the shift shock reduction control, the controller 60 reduces the opening of the actuation valve 69 by changing the value of the control signal outputted to the actuation valve 69 according to a straight traveling state or a turn traveling state of the machine body 2.

As illustrated in FIG. 1, the hydraulic system of the working machine includes an acquirer 67 and a determiner 70 and is capable of determining whether the machine body 2 is in a straight traveling state or in a turn traveling state. The determiner 70 is illustrated in FIG. 1, as being isolated from the controller 60, but may be incorporated in the controller 60 as a portion thereof.

The acquirer 67 acquires the number of revolutions and the rotation direction of each of the first traveling motor 36L and the second traveling motor 36R. In the first preferred embodiment, the acquirer 67 includes a rotation detection sensor 67L configured to detect the number of revolutions and the rotation direction of the first traveling motor 36L and a rotation detection sensor 67R configured to detect the number of revolutions and the rotation direction of the second traveling motor 36R.

The determiner 70 includes a semiconductor such as a CPU or an MPU, an electric/electronic circuit, etc. Based on the number of revolutions and the rotation direction of each of the first traveling motor 36L and the second traveling motor 36R that has been acquired by the acquirer 67, the determiner 70 determines whether the machine body 2 is in a straight traveling state, meaning traveling straight, or the machine body 2 is in a turn traveling state, meaning making a turn. In addition, the determiner 70 determines a pivot turn, a spin turn, a large turn, and a small turn in a turn traveling state.

Figure 3A:
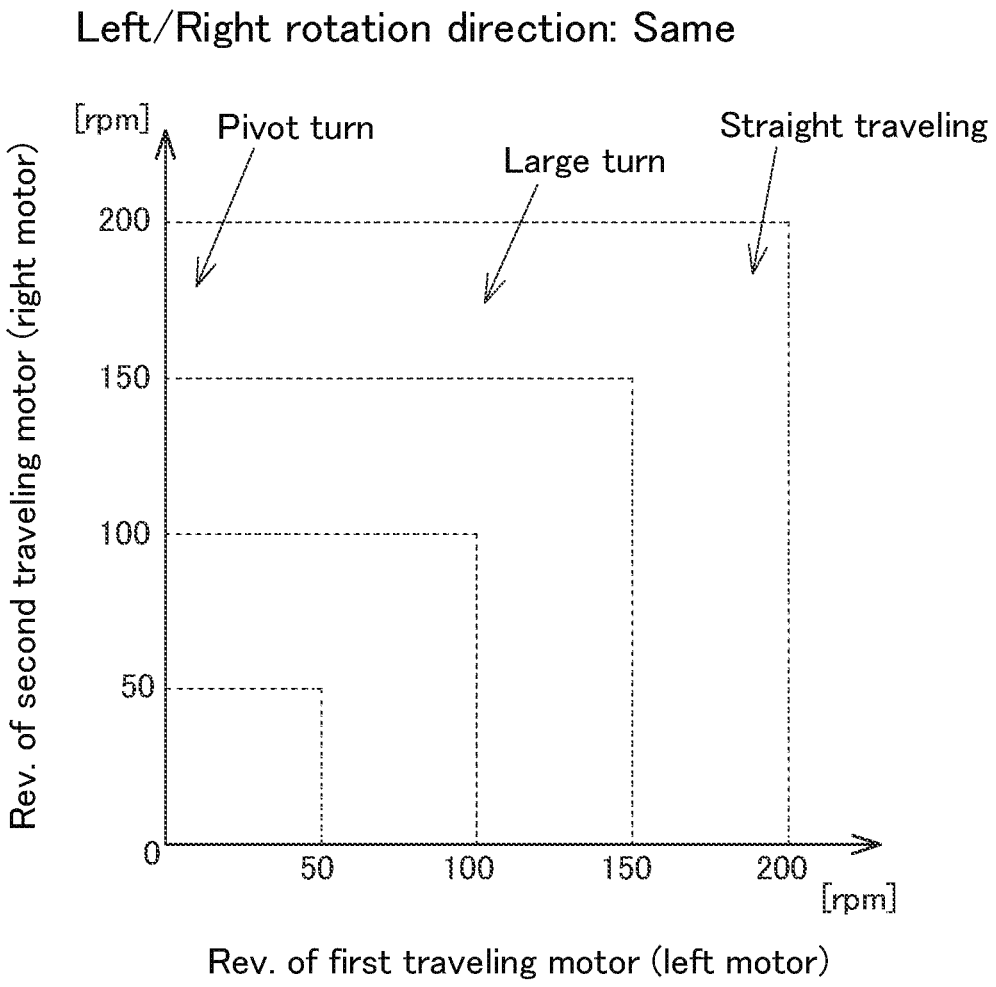
FIG. 3A is a diagram illustrating a method of determining a straight traveling state and a turn traveling state (a large turn and a pivot turn) of a machine body.

Specifically, the determiner 70 determines that the machine body 2 is in a straight traveling state (i) in a case where the rotation direction of the first traveling motor 36L is the same as the rotation direction of the second traveling motor 36R and, in addition, where the difference in the number of revolutions between the first traveling motor 36L and the second traveling motor 36R is zero or is less than a first difference having been determined in advance. The term "the difference in the number of revolutions" as used herein means an absolute value of the difference in the number of revolutions between the first traveling motor 36L and the second traveling motor 36R. It is assumed herein that the first difference is 5 rpm. The first difference is not limited to 5 rpm. For example, the first difference may be any value less than 5 rpm, or any value not greater than 10 rpm. For example, as illustrated in FIG. 3A, if the rotation direction of the first traveling motor 36L is the same as the rotation direction of the second traveling motor 36R and further if the number of revolutions of the first traveling motor 36L is 150 rpm and the number of revolutions of the second traveling motor 36R is 150 rpm, the determiner 70 determines that the difference between the two values is zero and thus determines that the machine body 2 is in a straight traveling state. As another example, if the rotation direction of the first traveling motor 36L is the same as the rotation direction of the second traveling motor 36R and further if the number of revolutions of the first traveling motor 36L is 148 rpm and the number of revolutions of the second traveling motor 36R is 150 rpm, the determiner 70 determines that the difference between the two values, 2 rpm, is less than the first difference having been determined in advance, 5 rpm, and thus determines that the machine body 2 is in a straight traveling state.

The determiner 70 determines that the machine body 2 is making a pivot turn (ii) in a case where either one of the first traveling motor 36L and the second traveling motor 36R, not both, is rotating. For example, as illustrated in FIG. 3A, the determiner 70 determines that the machine body 2 is making a pivot turn in a case where the first traveling motor 36L only is rotating at 100 rpm, with the rotation of the second traveling motor 36R stopped.

Figure 3B:
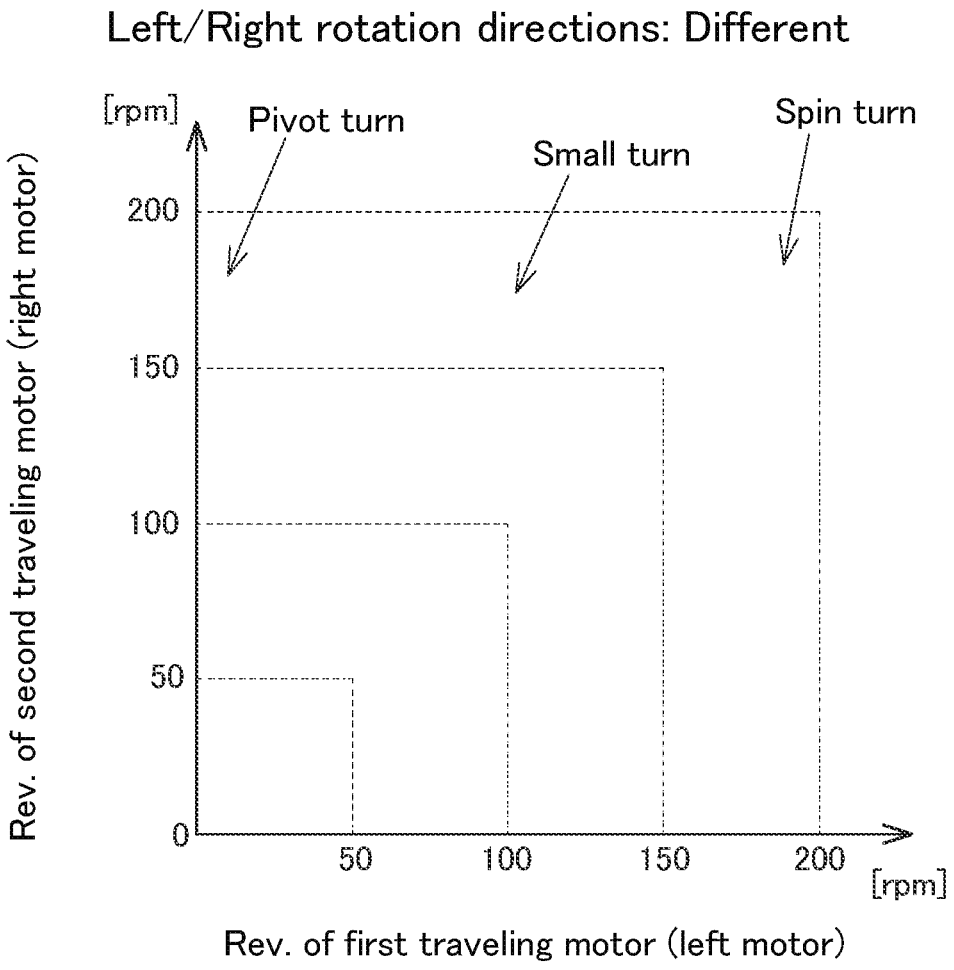
FIG. 3B is a diagram illustrating a method of determining a turn traveling state (a pivot turn, a small turn, and a spin turn) of a machine body.

The determiner 70 determines that the machine body 2 is making a spin turn (iii) in a case where the rotation direction of the first traveling motor 36L and the rotation direction of the second traveling motor 36R are the opposite of each other and, in addition, where the difference in the number of revolutions between the first traveling motor 36L and the second traveling motor 36R is zero or is less than the first difference. For example, as illustrated in FIG. 3B, if the rotation direction of the first traveling motor 36L and the rotation direction of the second traveling motor 36R are the opposite of each other and further if the number of revolutions of the first traveling motor 36L is 200 rpm and the number of revolutions of the second traveling motor 36R is 200 rpm, the determiner 70 determines that the difference between the two values is zero and thus determines that the machine body 2 is making a spin turn. As another example, if the rotation direction of the first traveling motor 36L and the rotation direction of the second traveling motor 36R are the opposite of each other and further if the number of revolutions of the first traveling motor 36L is 98 rpm and the number of revolutions of the second traveling motor 36R is 100 rpm, the determiner 70 determines that the difference between the two values, 2 rpm, is less than the first difference having been determined in advance, 5 rpm, and thus determines that the machine body 2 is making a spin turn.

The determiner 70 determines that the machine body 2 is making a large turn (iv) in a case where the rotation direction of the first traveling motor 36L is the same as the rotation direction of the second traveling motor 36R and, in addition, where the difference in the number of revolutions between the first traveling motor 36L and the second traveling motor 36R is greater than the first difference. For example, as illustrated in FIG. 3A, if the rotation direction of the first traveling motor 36L is the same as the rotation direction of the second traveling motor 36R and further if the number of revolutions of the first traveling motor 36L is 150 rpm and the number of revolutions of the second traveling motor 36R is 200 rpm, the determiner 70 determines that the difference between the two values, 50 rpm, is greater than the first difference having been determined in advance, 5 rpm, and thus determines that the machine body 2 is making a large turn.

The determiner 70 determines that the machine body 2 is making a small turn (v) in a case where the rotation direction of the first traveling motor 36L and the rotation direction of the second traveling motor 36R are the opposite of each other and, in addition, where the difference in the number of revolutions between the first traveling motor 36L and the second traveling motor 36R is greater than the first difference. For example, as illustrated in FIG. 3B, if the rotation direction of the first traveling motor 36L and the rotation direction of the second traveling motor 36R are the opposite of each other and further if the number of revolutions of the first traveling motor 36L is 150 rpm and the number of revolutions of the second traveling motor 36R is 200 rpm, the determiner 70 determines that the difference between the two values, 50 rpm, is greater than the first difference having been determined in advance, 5 rpm, and thus determines that the machine body 2 is making a small turn.

The controller 60 reduces an amount of hydraulic fluid supply to the first traveling motor 36L and the second traveling motor 36R by reducing traveling pilot pressure, which is hydraulic fluid pressure acting on the first traveling pump 53L and the second traveling pump 53R, according to the straight traveling state or the turn traveling state (a pivot turn, a spin turn, a large turn, a small turn) of the machine body 2 that has been determined by the determiner 70. For example, the controller 60 sets an amount of reduction ΔF11 in opening of the actuation valve 69 such that it differs according to the straight traveling state or the turn traveling state (a pivot turn, a spin turn, a large turn, a small turn) of the machine body 2 that has been determined by the determiner 70. For example, the controller 60 sets the amount of reduction ΔF11 in opening of the actuation valve 69 such that it becomes smaller in the order of a straight traveling state>a turn traveling state. In addition, for a turn traveling state, the controller 60 sets the amount of reduction ΔF11 in opening of the actuation valve 69 such that it becomes smaller in the order of, for example, a large turn>a pivot turn>a small turn>a spin turn. That is, the controller 60 sets an amount of reduction in traveling pilot pressure such that it becomes smaller in the order of a straight traveling state>a large turn>a pivot turn>a small turn>a spin turn.

Specifically, as illustrated in FIG. 3C, the controller 60 has a control map in which, for each of a straight traveling state and a turn traveling state, an amount of reduction in opening of the actuation valve 69 has been set in advance for each of a plurality of number-of-revolutions segments (e.g., four segments) obtained by performing multiple-range segmentation (e.g., division into four) of the number of revolutions of the first, second traveling motor 36L, 36R. In the control map illustrated in FIG. 3C, an amount of reduction for a case where the traveling state is "straight traveling" and where the number of revolutions of the first, second traveling motor 36L, 36R is 200 rpm has been set as the amount of reduction ΔF11 in advance. In addition, in the control map illustrated in FIG. 3C, for "straight traveling", which indicates a straight traveling state, and for each of "pivot turn", "spin turn", "large turn", and "small turn", all of which indicate a turn traveling state, gain percentage has been set in advance for each of the four number-of-revolutions (motor rev.) segments (50, 100, 150, 200 rpm), and a value obtained by multiplying the amount of reduction ΔF11 by the gain percentage is set as the amount of reduction. For example, in a case where the traveling state is "straight traveling" and where the larger one of the number of revolutions of the first traveling motor 36L and the number of revolutions of the second traveling motor 36R is 200 rpm, the controller 60 decides a value obtained by multiplying the amount of reduction ΔF11 by the gain percentage (=100%) as the amount of reduction "ΔF11×1". In a case where the traveling state is "pivot turn" and where the larger one of the number of revolutions of the first traveling motor 36L and the number of revolutions of the second traveling motor 36R is 200 rpm, the controller 60 decides a value obtained by multiplying the amount of reduction ΔF11 by the gain percentage (=60%) as the amount of reduction "ΔF11×0.6". In a case where the traveling state is "spin turn" and where the larger one of the number of revolutions of the first traveling motor 36L and the number of revolutions of the second traveling motor 36R is 150 rpm, the controller 60 decides a value obtained by multiplying the amount of reduction ΔF11 by the gain percentage (=20%) as the amount of reduction "ΔF11×0.2".

Figure 3D:
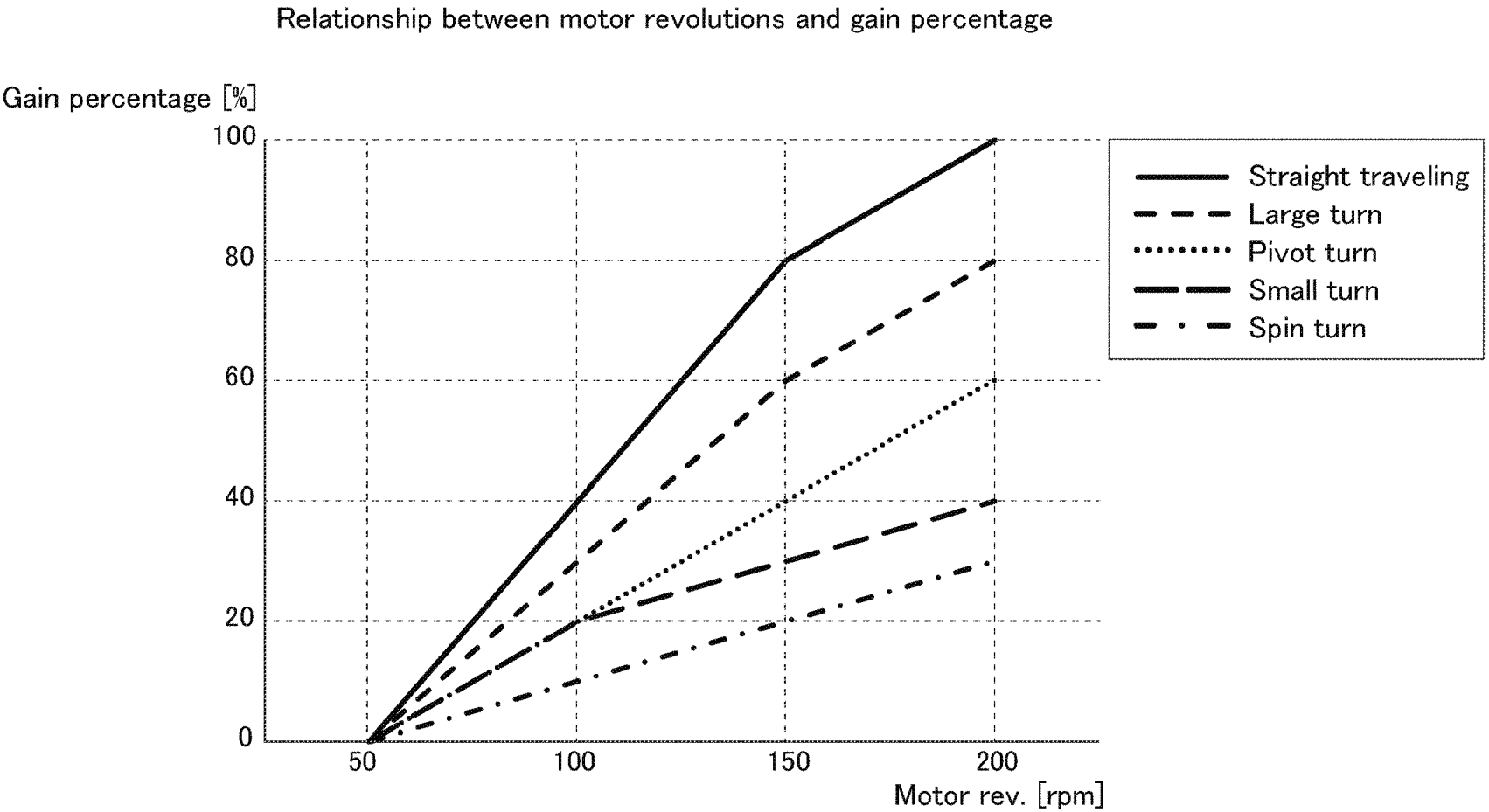
FIG. 3D is a graph showing a relationship between motor revolutions and gain percentage for each of a straight traveling state and a turn traveling state.

As illustrated in FIG. 3D, within the range of motor revolutions from 50 to 100 rpm, the gain percentage becomes smaller in the order of "straight traveling" of a straight traveling state>"large turn">"pivot turn"="small turn">"spin turn" of a turn traveling state. Within the ranges in which motor revolutions exceed 100 rpm, the gain percentage becomes smaller in the order of "straight traveling" of a straight traveling state>"large turn">"pivot turn">"small turn">"spin turn" of a turn traveling state. That is, the control map contains a preset amount of reduction in traveling pilot pressure for each of the plurality of number-of-revolutions segments described above.

With reference to the flowchart of FIG. 4, shift shock reduction control at the time of shift-up operation and shift-down operation will now be explained in detail.

First, shift shock reduction control at the time of shift-up operation will now be explained.

When the selector switch (SW) 61 is operated by the operator, the controller 60 determines whether shifting up the speed stage of the machine body 2 (the working machine) is commanded or not (S11). Specifically, the selector switch 61, if pushed by the operator while the traveling motor is rotating at the first speed, outputs a shift-up command (a command to shift to "second") for switching from the first state (the first speed) to the second state (the second speed) to the controller 60. The selector switch 61, if pushed by the operator while the traveling motor is rotating at the second speed, outputs a shift-down command (a command to shift to "first") for switching from the second state (the second speed) to the first state (the first speed) to the controller 60. In an example described here, it is assumed that the selector switch 61 outputs a command to shift to "second". Upon receiving the command to shift to "second", the controller 60 determines that shifting up the speed stage of the machine body 2 (the working machine) is commanded (S11: Yes). Then, the controller 60 outputs a determination command to the determiner 70.

Upon receiving the determination command, based on the number of revolutions and the rotation direction of each of the first traveling motor 36L and the second traveling motor 36R that has been acquired by the acquirer 67, the determiner 70 determines whether the machine body 2 is in a straight traveling state or in a turn traveling state (S12).

The determiner 70 may be configured to, upon operation of the selector switch 61, determine whether shifting up the speed stage of the machine body 2 (the working machine) is commanded or not (S11), and determine whether the machine body 2 is in a straight traveling state or in a turn traveling state (a pivot turn, a spin turn, a large turn, a small turn) (S12).

The controller 60 computes, by using the control map illustrated in FIG. 3C, the amount of reduction ΔF11 in opening of the actuation valve 69 at the time of shift-up operation (S13) according to the straight traveling state or the turn traveling state (a pivot turn, a spin turn, a large turn, a small turn) of the machine body 2 that has been determined by the determiner 70. Based on the computed amount of reduction ΔF11, the controller 60 performs shift shock reduction control (S14).

Figure 5:
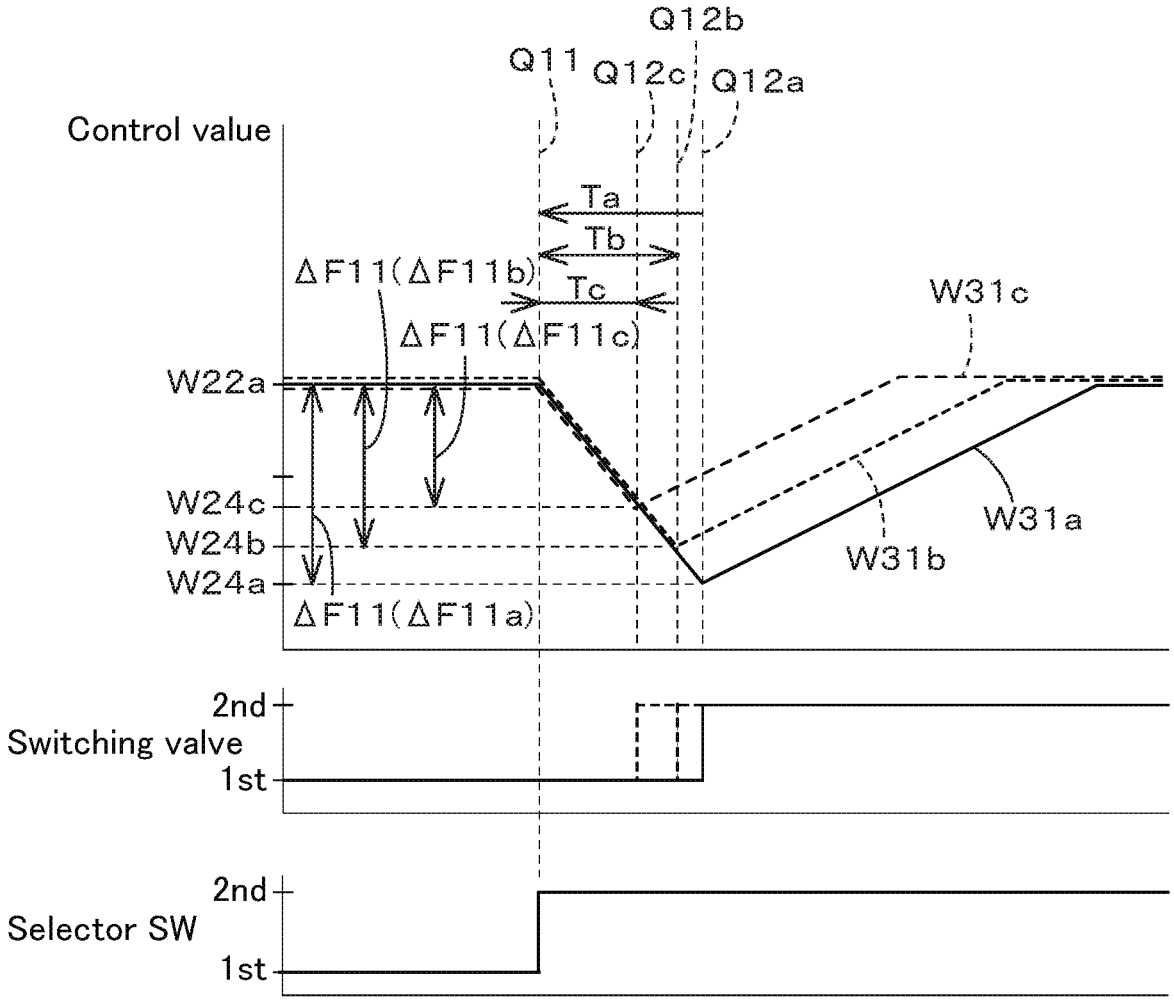
FIG. 5 is a diagram illustrating a relationship between the number of revolutions of a prime mover and the switching of a traveling motor in a case where the speed of the traveling motor is increased.

FIG. 5 is a diagram illustrating a relationship between the respective control values of three control signals for straight traveling, a pivot turn, and a spin turn (reduced values W24*a*, W24*b*, and W24*c*) and the switching of the traveling motor in a case where shift shock reduction control at the time of shift-up operation is performed. In FIG. 5, the reduced value W24*a* for straight traveling, the reduced value W24*b* for a pivot turn, and the reduced value W24*c* for a spin turn are shown for a case where the larger one of the number of revolutions of the first traveling motor 36L and the number of revolutions of the second traveling motor 36R is 200 rpm.

First, shift-up operation for a case where the machine body 2 is in a straight traveling state will be described in this paragraph. Let us assume that, at a point in time Q11, the selector switch 61 is operated, and the controller 60 acquires a shift-up command (a command to shift to "second") for switching from the first state (the first speed) to the second state (the second speed). Then, the determiner 70 determines that the machine body 2 is in a straight traveling state. Looking up the control map illustrated in FIG. 3C, the controller 60 identifies the gate percentage as (100%), which corresponds to the state of "straight traveling" at the number of revolutions of the motor of 200 rpm, and multiplies the amount of reduction ΔF11 by the gain percentage "1=100%" to compute an amount of reduction ΔF11*a* (=an amount of reduction "ΔF11×1"). As illustrated in FIG. 5, when the machine body 2 is in a straight traveling state, the controller 60 sets the amount of reduction ΔF11*a* at the point in time Q11.

Next, shift-up operation for a case where the machine body 2 is making a pivot turn will be described. Let us assume that, at the point in time Q11, the selector switch 61 is operated, and the controller 60 acquires a command to shift to "second". Then, the determiner 70 determines that the machine body 2 is making a pivot turn. Looking up the control map illustrated in FIG. 3C, the controller 60 identifies the gate percentage as (60%), which corresponds to the state of making a "pivot turn" at the number of revolutions of the motor of 200 rpm, and multiplies the amount of reduction ΔF11 by the gain percentage "0.6=60%" to compute an amount of reduction ΔF11*b* (=an amount of reduction "ΔF11×0.6"). As illustrated in FIG. 5, when the machine body 2 is making a pivot turn, the controller 60 sets the amount of reduction ΔF11*b* at the point in time Q11.

Next, shift-up operation for a case where the machine body 2 is making a spin turn will be described. Let us assume that, at the point in time Q11, the selector switch 61 is operated, and the controller 60 acquires a command to shift to "second". Then, the determiner 70 determines that the machine body 2 is making a spin turn. Looking up the control map illustrated in FIG. 3C, the controller 60 identifies the gate percentage as (30%), which corresponds to the state of making a "spin turn" at the number of revolutions of the motor of 200 rpm, and multiplies the amount of reduction ΔF11 by the gain percentage "0.3=30%" to compute an amount of reduction ΔF11*c* (=an amount of reduction "ΔF11×0.3"). As illustrated in FIG. 5, when the machine body 2 is making a spin turn, the controller 60 sets the amount of reduction ΔF11*c* at the point in time Q11.

Upon completing the setting of the amount of reduction ΔF11, the controller 60 sets, as the reduced value W24*a*, W24*b*, W24*c* in shift shock reduction control, a value obtained by subtracting the amount of reduction ΔF11 (ΔF11*a*, ΔF11*b*, ΔF11*c*) from a control value W22*a* of an "immediately-before-reduction" control signal. For example, when the machine body 2 is in a straight traveling state, the controller 60 sets, as the reduced value W24*a*, a value obtained by subtracting the amount of reduction ΔF11*a* from the "immediately-before-reduction" control value W22*a*. Alternatively, when the machine body 2 is making a pivot turn, the controller 60 sets, as the reduced value W24*b*, a value obtained by subtracting the amount of reduction ΔF11*b* from the "immediately-before-reduction" control value W22*a*. Alternatively, when the machine body 2 is making a spin turn, the controller 60 sets, as the reduced value W24*c*, a value obtained by subtracting the amount of reduction ΔF11*c* from the "immediately-before-reduction" control value W22*a*.

Upon completing the setting of the reduced value W24*a*, W24*b*, W24*c*, the controller 60 decreases the control value outputted to the actuation valve 69 until reaching the reduced value W24*a*, W24*b*, W24*c*.

Specifically, at the point in time Q11, when the machine body 2 is in a straight traveling state, the controller 60 starts decreasing the control value toward the reduced value W24*a* as indicated by a line W31*a*. At a point in time Q12*a*, the control value reaches the reduced value W24*a* as indicated by the line W31*a*. Upon reaching the reduced value W24*a*, the controller 60 outputs a signal for solenoid energization of the traveling switching valve 34, thereby switching the traveling switching valve 34 (switching valve) from the first state (first speed) to the second state (second speed). After the point in time Q12*a*, the controller 60 causes the control value to return toward the "immediately-before-reduction" control value W22*a* as indicated by the line W31*a*.

Alternatively, at the point in time Q11, when the machine body 2 is making a pivot turn, the controller 60 starts decreasing the control value toward the reduced value W24*b* as indicated by a line W31*b*. At a point in time Q12*b*, the control value reaches the reduced value W24*b* as indicated by the line W31*b*. Upon reaching the reduced value W24*b*, the controller 60 outputs a signal for solenoid energization of the traveling switching valve 34, thereby switching the traveling switching valve 34 (switching valve) from the first state (first speed) to the second state (second speed). After the point in time Q12*b*, the controller 60 causes the control value to return toward the "immediately-before-reduction" control value W22*a* as indicated by the line W31*b*.

Alternatively, at the point in time Q11, when the machine body 2 is making a spin turn, the controller 60 starts decreasing the control value toward the reduced value W24*c* as indicated by a line W31*c*. At a point in time Q12*c*, the control value reaches the reduced value W24*c* as indicated by the line W31*c*. Upon reaching the reduced value W24*c*, the controller 60 outputs a signal for solenoid energization of the traveling switching valve 34, thereby switching the traveling switching valve 34 (switching valve) from the first state (first speed) to the second state (second speed). After the point in time Q12*c*, the controller 60 causes the control value to return toward the "immediately-before-reduction" control value W22*a* as indicated by the line W31*c*.

Let us focus on reduction intervals Ta, Tb, and Tc, which are from the point in time Q11, at which the decreasing of the control values of the control signals starts, to the points in time Q12*a*, Q12*b*, and Q12*c*, at which the decreasing of the control values of the control signals ends respectively, namely, at which the control values of the control signals reach the reduced values W24*a*, W24*b*, and W24*c* respectively. Focusing on the reduction intervals Ta, Tb, and Tc reveals that the controller 60 sets a first reduction rate of the control values to be constant. That is, the controller 60 sets a constant inclination for the lines W31*a*, W31*b*, and W31*c* in the reduction intervals Ta, Tb, and Tc.

In addition, as can be seen from the fact that the traveling switching valve 34 switches from the first state to the second state at the point in time Q12*a*, Q12*b*, Q12*c*, the controller 60 sets the timing of the switching of the traveling switching valve 34 from the first state to the second state to be different depending on whether the machine body 2 is in a straight traveling state, is making a pivot turn, or is making a spin turn.

Though neither of a case of a large turn and a case of a small turn is illustrated in FIG. 5, the controller 60 is able to set the amount of reduction ΔF11 for the case of a large turn and the case of a small turn in the same manner as above. For example, looking up the control map illustrated in FIG. 3C, the controller 60 identifies the gate percentage as (80%), which corresponds to a case where the machine body 2 is making a large turn at the number of revolutions of the motor of 200 rpm, and multiplies the amount of reduction ΔF11 by the gain percentage "0.8=80%" to compute an amount of reduction "ΔF11×0.8". Then, the controller 60 sets a value obtained by subtracting the amount of reduction "ΔF11×0.8" from the "immediately-before-reduction" control value W22*a* as the reduced value (an intermediate value between W24*a* and W24*b*). Alternatively, looking up the control map illustrated in FIG. 3C, the controller 60 identifies the gate percentage as (40%), which corresponds to a case where the machine body 2 is making a small turn at the number of revolutions of the motor of 200 rpm, and multiplies the amount of reduction ΔF11 by the gain percentage "0.4=40%" to compute an amount of reduction "ΔF11×0.4". Then, the controller 60 sets a value obtained by subtracting the amount of reduction "ΔF11×0.4" from the "immediately-before-reduction" control value W22*a* as the reduced value (an intermediate value between W24*b* and W24*c*).

Figure 6:
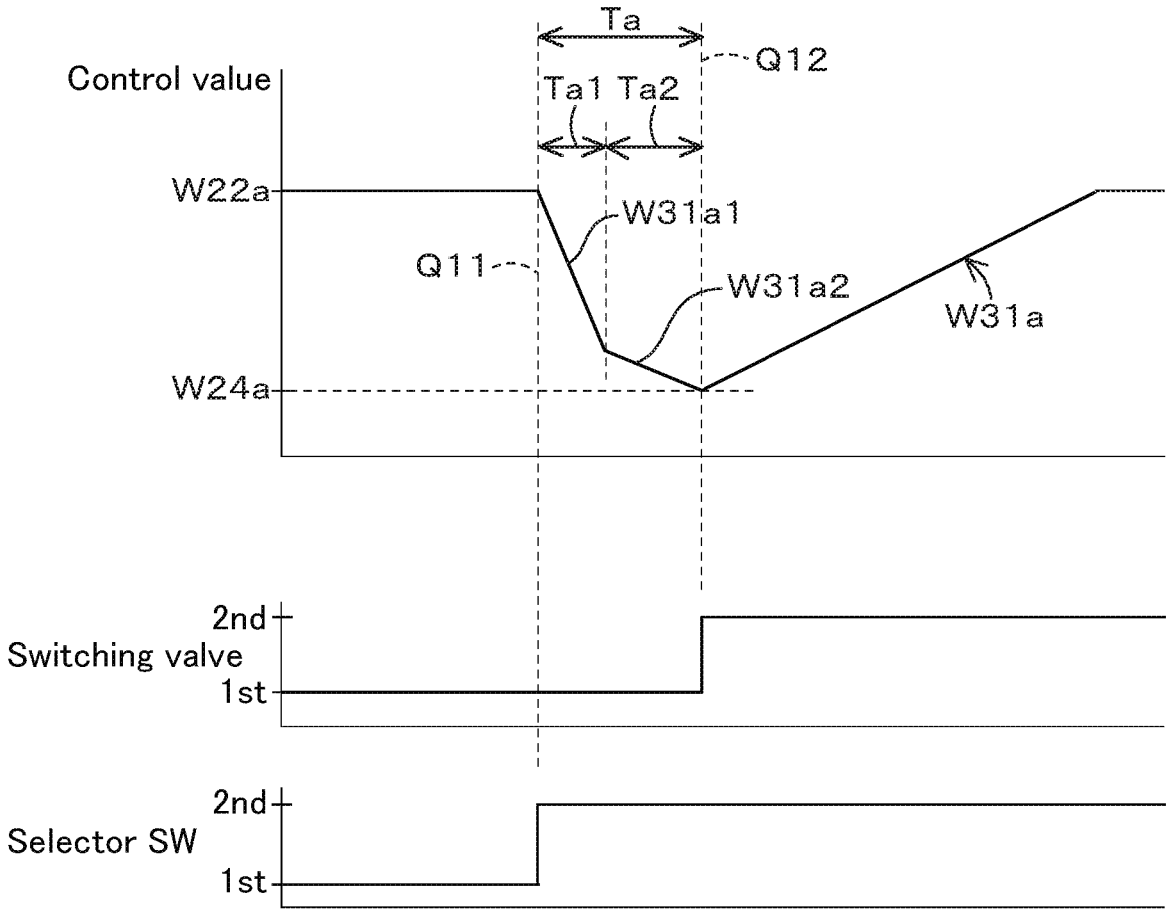
FIG. 6 is a diagram illustrating a relationship between the number of revolutions of a prime mover and the switching of a traveling motor according to a modification example.

In the first preferred embodiment described above, in each of the reduction intervals Ta, Tb, and Tc, the controller 60 sets the reduction rate of the control value of the control signal (opening) to be constant throughout the reduction interval Ta, Tb, Tc from the starting point to the ending point. However, for example, as illustrated in FIG. 6, the reduction rate may be changed somewhere between the starting point and the ending point. FIG. 6 illustrates a modification example in which, in the reduction interval Ta, the reduction rate of the control value of the control signal is changed somewhere between the starting point and the ending point.

The controller 60 acquires a command to shift to "second", and computes the reduced value W24*a* according to a straight traveling state or a turn traveling state; then, as illustrated in FIG. 6, the controller 60 sets the reduction rate of the control value in an interval (first interval) Ta1, which is from the starting point of the reduction interval Ta to some midpoint therein, to be a second reduction rate, and sets the reduction rate of the control value in an interval (second interval) Ta2, which is from said some midpoint to the ending point of the reduction interval Ta, to be a third reduction rate. That is, on a line W31*a* expressing the control value in the reduction interval Ta, the controller 60 sets the second reduction rate in the first interval Ta1 by means of the inclination of a line W31*a*1 and sets the third reduction rate in the second interval Ta2 by means of the inclination of a line W31*a*2. The controller 60 sets the second reduction rate (the inclination of the line W31*a*1) to be higher (steeper) than the third reduction rate (the inclination of the line W31*a*2).

Though the line W31*a* is described in this modification example, the second reduction rate and the third reduction rate may be set for the other lines W31*b* and W31*c* in the same manner as done for the line W31*a*. In this case, the above description should be read while replacing the reduced value W24*a* with the reduced value W24*b*, W24*c*, replacing the reduction interval Ta with the reduction interval Tb, Tc, replacing the line W31*a* with the line W31*b*, W31*c*, replacing the line W31*a*1 with a line W31*b*1, W31*c*1, replacing the line W31*a*2 with a line W31*b*2, W31*c*2, replacing the first interval Ta1 with a first interval Tb1, Tc1, and replacing the second interval Ta2 with a second interval Tb2, Tc2.

Next, shift shock reduction control at the time of shift-down operation will now be explained. In an example described here, it is assumed that the selector switch 61 outputs a shift-down command (a command to shift to "first") in S11 of FIG. 4. Because of acquisition of the command to shift to "first" from the selector switch 61, the controller 60 determines that shifting up the speed stage of the machine body 2 (the working machine) is not commanded (S11: No), determines that shifting down the speed stage of the machine body 2 (the working machine) is commanded (S15: Yes), and outputs a determination command to the determiner 70. If the controller 60 determines that shifting down the speed stage of the machine body 2 (the working machine) is not commanded (S15: No), the process returns to S11.

Upon receiving the determination command, based on the number of revolutions and the rotation direction of each of the first traveling motor 36L and the second traveling motor 36R that has been acquired by the acquirer 67, the determiner 70 determines whether the machine body 2 is in a straight traveling state or in a turn traveling state (S16).

The determiner 70 may be configured to, upon operation of the selector switch 61, determine whether shifting down the speed stage of the machine body 2 (the working machine) is commanded or not (S15), and determine whether the machine body 2 is in a straight traveling state or in a turn traveling state (a pivot turn, a spin turn, a large turn, a small turn) (S16).

The controller 60 computes, by using the control map illustrated in FIG. 3C, the amount of reduction ΔF11 in opening of the actuation valve 69 at the time of shift-down operation (S17) according to the straight traveling state or the turn traveling state (a pivot turn, a spin turn, a large turn, a small turn) of the machine body 2 that has been determined by the determiner 70. Based on the computed amount of reduction ΔF11, the controller 60 performs shift shock reduction control (S14). The amount of reduction ΔF11 in opening of the actuation valve 69 at the time of shift-down operation according to a straight traveling state or a turn traveling state (a pivot turn, a spin turn, a large turn, a small turn) is computed in the same manner as done in the case of shift-up operation. Therefore, description regarding the amount of reduction in the case of shift-down operation is omitted. The controller 60 performs shift shock reduction control based on the amount of reduction ΔF11 at the time of shift-down operation (S14).

Figure 7:
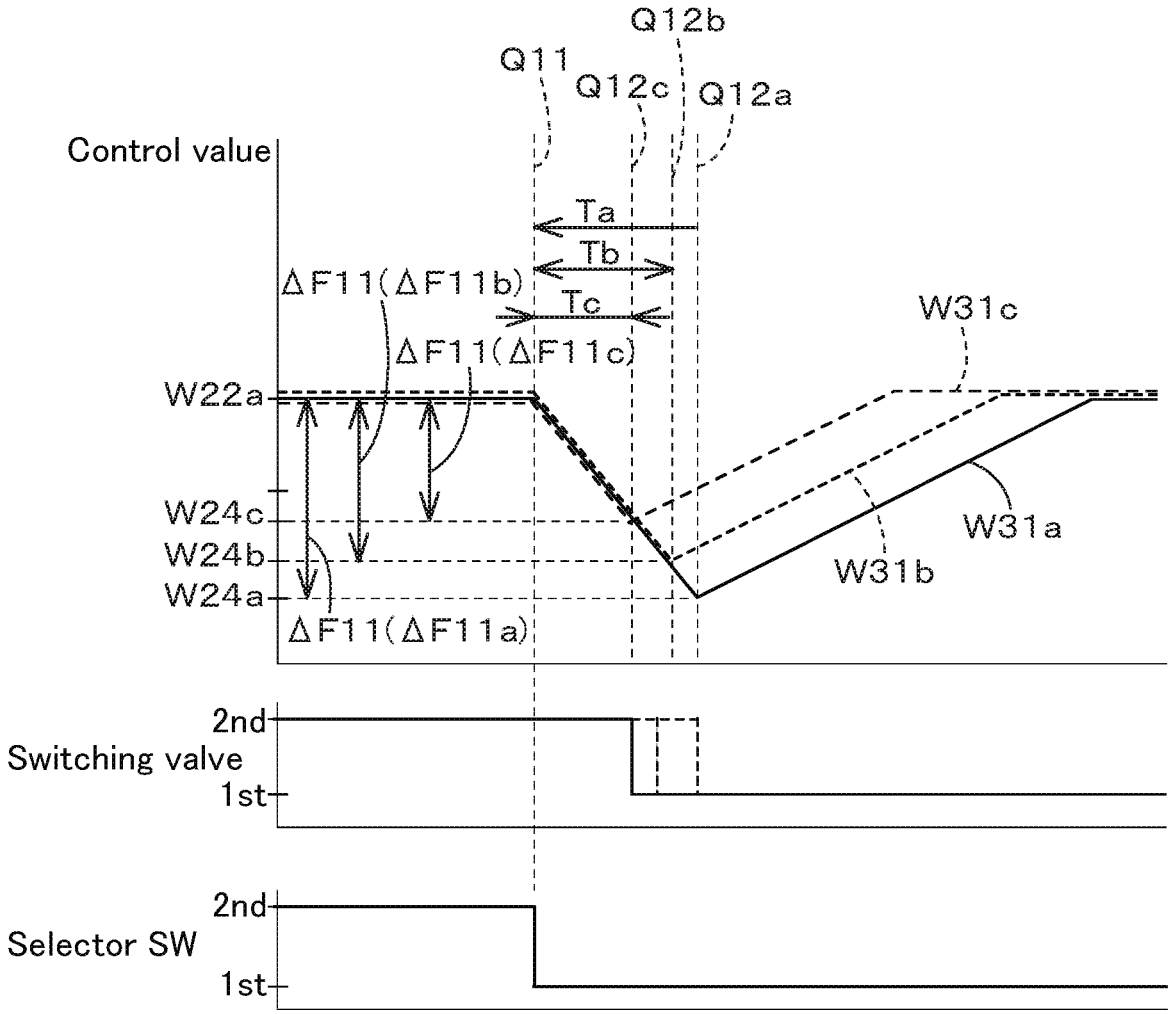
FIG. 7 is a diagram illustrating a relationship between the number of revolutions of a prime mover and the switching of a traveling motor in a case where the speed of the traveling motor is decreased.

FIG. 7 is a diagram illustrating a relationship between the respective control values of three control signals for straight traveling, a pivot turn, and a spin turn (reduced values W24*a*, W24*b*, and W24*c*) and the switching of the traveling motor in a case where shift shock reduction control at the time of shift-down operation is performed. In FIG. 7, the reduced value W24*a* for straight traveling, the reduced value W24*b* for a pivot turn, and the reduced value W24*c* for a spin turn are shown for a case where the larger one of the number of revolutions of the first traveling motor 36L and the number of revolutions of the second traveling motor 36R is 200 rpm.

First, shift-down operation for a case where the machine body 2 is in a straight traveling state will be described in this paragraph. Let us assume that, at a point in time Q11, the selector switch 61 is operated, and the controller 60 acquires a shift-down command (a command to shift to "first") for switching from the second state (the second speed) to the first state (the first speed). Then, the determiner 70 determines that the machine body 2 is in a straight traveling state. Looking up the control map illustrated in FIG. 3C, the controller 60 identifies the gate percentage as (100%), which corresponds to the state of "straight traveling" at the number of revolutions of the motor of 200 rpm, and multiplies the amount of reduction ΔF11 by the gain percentage "1=100%" to compute an amount of reduction ΔF11*a* (=an amount of reduction "ΔF11×1"). As illustrated in FIG. 7, when the machine body 2 is in a straight traveling state, the controller 60 sets the amount of reduction ΔF11*a* at the point in time Q11.

Next, shift-down operation for a case where the machine body 2 is making a pivot turn will be described. Let us assume that, at the point in time Q11, the selector switch 61 is operated, and the controller 60 acquires a command to shift to "first". Then, the determiner 70 determines that the machine body 2 is making a pivot turn. Looking up the control map illustrated in FIG. 3C, the controller 60 identifies the gate percentage as (60%), which corresponds to the state of making a "pivot turn" at the number of revolutions of the motor of 200 rpm, and multiplies the amount of reduction ΔF11 by the gain percentage "0.6=60%" to compute an amount of reduction ΔF11*b* (=an amount of reduction "ΔF11×0.6"). As illustrated in FIG. 7, when the machine body 2 is making a pivot turn, the controller 60 sets the amount of reduction ΔF11*b* at the point in time Q11.

Next, shift-down operation for a case where the machine body 2 is making a spin turn will be described. Let us assume that, at the point in time Q11, the selector switch 61 is operated, and the controller 60 acquires a command to shift to "first". Then, the determiner 70 determines that the machine body 2 is making a spin turn. Looking up the control map illustrated in FIG. 3C, the controller 60 identifies the gate percentage as (30%), which corresponds to the state of making a "spin turn" at the number of revolutions of the motor of 200 rpm, and multiplies the amount of reduction ΔF11 by the gain percentage "0.3=30%" to compute an amount of reduction ΔF11*c* (=an amount of reduction "ΔF11×0.3"). As illustrated in FIG. 7, when the machine body 2 is making a spin turn, the controller 60 sets the amount of reduction ΔF11*c* at the point in time Q11.

Upon completing the setting of the amount of reduction ΔF11, the controller 60 sets, as the reduced value W24*a*, W24*b*, W24*c* in shift shock reduction control, a value obtained by subtracting the amount of reduction ΔF11 (ΔF11*a*, ΔF11*b*, ΔF11*c*) from a control value W22*a* of an "immediately-before-reduction" control signal. For example, when the machine body 2 is in a straight traveling state, the controller 60 sets, as the reduced value W24*a*, a value obtained by subtracting the amount of reduction ΔF11*a* from the "immediately-before-reduction" control value W22*a*. Alternatively, when the machine body 2 is making a pivot turn, the controller 60 sets, as the reduced value W24*b*, a value obtained by subtracting the amount of reduction ΔF11*b* from the "immediately-before-reduction" control value W22*a*. Alternatively, when the machine body 2 is making a spin turn, the controller 60 sets, as the reduced value W24*c*, a value obtained by subtracting the amount of reduction ΔF11*c* from the "immediately-before-reduction" control value W22*a*.

Upon completing the setting of the reduced value W24*a*, W24*b*, W24*c*, the controller 60 decreases the control value outputted to the actuation valve 69 until reaching the reduced value W24*a*, W24*b*, W24*c*.

Specifically, at the point in time Q11, when the machine body 2 is in a straight traveling state, the controller 60 starts decreasing the control value toward the reduced value W24*a* as indicated by a line W31*a*. At a point in time Q12*a*, the control value reaches the reduced value W24*a* as indicated by the line W31*a*. Upon reaching the reduced value W24*a*, the controller 60 outputs a signal for solenoid energization of the traveling switching valve 34, thereby switching the traveling switching valve 34 (switching valve) from the second state (second speed) to the first state (first speed). After the point in time Q12*a*, the controller 60 causes the control value to return toward the "immediately-before-reduction" control value W22*a* as indicated by the line W31*a*.

Alternatively, at the point in time Q11, when the machine body 2 is making a pivot turn, the controller 60 starts decreasing the control value toward the reduced value W24*b* as indicated by a line W31*b*. At a point in time Q12*b*, the control value reaches the reduced value W24*b* as indicated by the line W31*b*. Upon reaching the reduced value W24*b*, the controller 60 outputs a signal for solenoid energization of the traveling switching valve 34, thereby switching the traveling switching valve 34 (switching valve) from the second state (second speed) to the first state (first speed). After the point in time Q12*b*, the controller 60 causes the control value to return toward the "immediately-before-reduction" control value W22*a* as indicated by the line W31*b*.

Alternatively, at the point in time Q11, when the machine body 2 is making a spin turn, the controller 60 starts decreasing the control value toward the reduced value W24*c* as indicated by a line W31*c*. At a point in time Q12*c*, the control value reaches the reduced value W24*c* as indicated by the line W31*c*. Upon reaching the reduced value W24*c*, the controller 60 outputs a signal for solenoid energization of the traveling switching valve 34, thereby switching the traveling switching valve 34 (switching valve) from the second state (second speed) to the first state (first speed). After the point in time Q12*c*, the controller 60 causes the control value to return toward the "immediately-before-reduction" control value W22*a* as indicated by the line W31*c*.

Let us focus on reduction intervals Ta, Tb, and Tc, which are from the point in time Q11, at which the decreasing of the control values of the control signals starts, to the points in time Q12*a*, Q12*b*, and Q12*c*, at which the decreasing of the control values of the control signals ends respectively, namely, at which the control values of the control signals reach the reduced values W24*a*, W24*b*, and W24*c* respectively. Focusing on the reduction intervals Ta, Tb, and Tc reveals that the controller 60 sets a first reduction rate of the control values to be constant. That is, the controller 60 sets a constant inclination for the lines W31*a*, W31*b*, and W31*c* in the reduction intervals Ta, Tb, and Tc.

In addition, as can be seen from the fact that the traveling switching valve 34 switches from the second state to the first state at the point in time Q12*a*, Q12*b*, Q12*c*, the controller 60 sets the timing of the switching of the traveling switching valve 34 from the second state to the first state to be different depending on whether the machine body 2 is in a straight traveling state, is making a pivot turn, or is making a spin turn.

Though neither of a case of a large turn and a case of a small turn is illustrated in FIG. 7, the amount of reduction ΔF11 for the case of a large turn and the case of a small turn can be set in the same manner as above. For example, looking up the control map illustrated in FIG. 3C, the controller 60 identifies the gate percentage as (80%), which corresponds to a case where the machine body 2 is making a large turn at the number of revolutions of the motor of 200 rpm, and multiplies the amount of reduction ΔF11 by the gain percentage "0.8=80%" to compute an amount of reduction "ΔF11×0.8". Then, the controller 60 sets a value obtained by subtracting the amount of reduction "ΔF11×0.8" from the "immediately-before-reduction" control value W22*a* as the reduced value (an intermediate value between W24*a* and W24*b*). Alternatively, looking up the control map illustrated in FIG. 3C, the controller 60 identifies the gate percentage as (40%), which corresponds to a case where the machine body 2 is making a small turn at the number of revolutions of the motor of 200 rpm, and multiplies the amount of reduction ΔF11 by the gain percentage "0.4=40%" to compute an amount of reduction "ΔF11×0.4". Then, the controller 60 sets a value obtained by subtracting the amount of reduction "ΔF11×0.4" from the "immediately-before-reduction" control value W22*a* as the reduced value (an intermediate value between W24*b* and W24*c*).

The working machine according to the first preferred embodiment described above includes: the machine body 2; the first traveling pump 53L and the second traveling pump 53R; the acquirer 67 configured to acquire the number of revolutions and the rotation direction of each of the first traveling motor 36L and the second traveling motor 36R; the determiner 70 configured to, based on the number of revolutions and the rotation direction of each of the first traveling motor 36L and the second traveling motor 36R that has been acquired by the acquirer 67, determine whether the machine body 2 is in a straight traveling state or in a turn traveling state; and the controller 60 configured to, when switching from the first state, in which the rotation speeds of the first traveling motor 36L and the second traveling motor 36R can be increased up to the first maximum speed, to the second state, in which the rotation speeds of the first traveling motor 36L and the second traveling motor 36R can be increased up to the second maximum speed higher than the first maximum speed, is performed, or switching from the second state to the first state is performed, reduce an amount of hydraulic fluid supply from the first traveling pump 53L and the second traveling pump 53R to the first traveling motor 36L and the second traveling motor 36R according to the straight traveling state or the turn traveling state of the machine body 2.

In this configuration, based on the number of revolutions and the rotation direction of each of the first traveling motor 36L and the second traveling motor 36R, the determiner 70 determines whether the machine body 2 is in a straight traveling state, meaning traveling straight, or the machine body 2 is in a turn traveling state, meaning making a turn. Therefore, it is possible to determine whether the machine body 2 is in a straight traveling state or a turn traveling state accurately. The controller 60 reduces an amount of hydraulic fluid supply from the first traveling pump 53L and the second traveling pump 53R to the first traveling motor 36L and the second traveling motor 36R according to the straight traveling state or the turn traveling state of the machine body 2. Therefore, it is possible to set an appropriate reduced value for shift shock reduction control for each of a straight traveling state and a turn traveling state. Therefore, it is possible to reduce a shift shock appropriately when in a straight traveling state and when in a turn traveling state.

The following configuration is conceivable as a configuration for performing shift shock reduction control according to a degree of straight traveling of the machine body 2: a pressure detector configured to detect the pressure of a hydraulic fluid at each of the first to fourth traveling fluid passages 45*a* to 45*d* (traveling pilot pressure) is provided; the degree of straight traveling of the machine body 2 is calculated indirectly based on the front-rear/left-right ratio of the four values of traveling pilot pressure detected by the pressure detector; shift shock reduction control is performed according to the indirectly-calculated degree of straight traveling of the machine body 2. However, in this configuration, since shift shock reduction control is performed according to the indirectly-calculated degree of straight traveling of the machine body 2, sometimes a shift shock cannot be reduced appropriately. The reason is that, in this configuration, it is difficult to obtain accurate information on the vehicle speed of the machine body 2, and it is difficult to determine whether the machine body 2 is in a straight traveling state or in a turn traveling state accurately. By contrast, in the working machine according to the first preferred embodiment, it is possible to determine whether the machine body 2 is in a straight traveling state or in a turn traveling state accurately, and it is possible to obtain accurate information on the vehicle speed of the machine body 2. Therefore, it is possible to reduce a shift shock appropriately when in a straight traveling state and when in a turn traveling state.

The controller 60 reduces an amount of hydraulic fluid supply to the first traveling motor 36L and the second traveling motor 36R by reducing traveling pilot pressure, which is hydraulic fluid pressure acting on the first traveling pump 53L and the second traveling pump 53R, according to a straight traveling state or a turn traveling state of the machine body 2. Therefore, it is possible to perform shift shock reduction control appropriately not only when in a straight traveling state but also when in a turn traveling state. Specifically, the controller 60 sets an amount of reduction in opening of the actuation valve 69 according to a straight traveling state or a turn traveling state of the machine body 2. Therefore, it is possible to set an appropriate reduced value for shift shock reduction control for each of a straight traveling state and a turn traveling state.

The determiner 70 determines that the machine body 2 is in a straight traveling state (i) in a case where the rotation direction of the first traveling motor 36L is the same as the rotation direction of the second traveling motor 36R and, in addition, where the difference in the number of revolutions between the first traveling motor 36L and the second traveling motor 36R is zero or is less than a first difference having been determined in advance. The determiner 70 determines that the machine body 2 is making a pivot turn (ii) in a case where either one of the first traveling motor 36L and the second traveling motor 36R, not both, is rotating. The determiner 70 determines that the machine body 2 is making a spin turn (iii) in a case where the rotation direction of the first traveling motor 36L and the rotation direction of the second traveling motor 36R are the opposite of each other and, in addition, where the difference in the number of revolutions between the first traveling motor 36L and the second traveling motor 36R is zero or is less than the first difference. Therefore, the determiner 70 is able to perform accurate determination of a straight traveling state, and accurate determination of a pivot turn and a spin turn in a turn traveling state. The controller 60 sets an amount of reduction in opening of the actuation valve 69 according to a straight traveling state, a pivot turn, and a spin turn of the machine body 2. Therefore, it is possible to set an appropriate reduced value for shift shock reduction control for a straight traveling state, for a pivot turn, and for a spin turn. Therefore, it is possible to perform shift shock reduction control appropriately not only for a case of a straight traveling state but also for a case of plural kinds of a turn traveling state, specifically, a pivot turn and a spin turn.

The determiner 70 determines that the machine body 2 is making a large turn (iv) in a case where the rotation direction of the first traveling motor 36L is the same as the rotation direction of the second traveling motor 36R and, in addition, where the difference in the number of revolutions between the first traveling motor 36L and the second traveling motor 36R is greater than the first difference. The determiner 70 determines that the machine body 2 is making a small turn (v) in a case where the rotation direction of the first traveling motor 36L and the rotation direction of the second traveling motor 36R are the opposite of each other and, in addition, where the difference in the number of revolutions between the first traveling motor 36L and the second traveling motor 36R is greater than the first difference. Therefore, the determiner 70 is able to perform accurate determination of a large turn and a small turn in a turn traveling state. The controller 60 sets an amount of reduction in opening of the actuation valve 69 according to a large turn and a small turn of the machine body 2. Therefore, it is possible to set an appropriate reduced value for shift shock reduction control for a large turn and for a small turn. Therefore, it is possible to perform shift shock reduction control appropriately for a case of plural kinds of a turn traveling state, specifically, a large turn and a small turn.

The controller 60 sets an amount of reduction in opening of the actuation valve 69 such that it becomes smaller in the order of a straight traveling state>a large turn>a pivot turn>a small turn>a spin turn. That is, the controller 60 sets an amount of reduction in traveling pilot pressure such that it becomes smaller in the order of a straight traveling state>a large turn>a pivot turn>a small turn>a spin turn. Therefore, it is possible to set an appropriate reduced value for shift shock reduction control for a straight traveling state, for a large turn, for a pivot turn, for a small turn, and for a spin turn. Therefore, it is possible to perform shift shock reduction control appropriately for a case of a straight traveling state and for a case of plural kinds of a turn traveling state (a large turn, a pivot turn, a small turn, a spin turn).

The controller 60 has a control map in which, for each of a straight traveling state and a turn traveling state, an amount of reduction in opening of the actuation valve 69 has been set in advance for each of a plurality of number-of-revolutions segments obtained by performing multiple-range segmentation of the number of revolutions of the first, second traveling motor 36L, 36R. The control map contains a preset amount of reduction in traveling pilot pressure for each of the plurality of number-of-revolutions segments described above. Therefore, for each of a straight traveling state and a turn traveling state, it is possible to control an amount of reduction in opening of the actuation valve 69 quickly by using a control map in which the amount of reduction in opening of the actuation valve 69 has been set in advance for each of the plurality of number-of-revolutions segments.

The acquirer 67 includes the rotation detection sensor 67L configured to detect the number of revolutions and the rotation direction of the first traveling motor 36L and the rotation detection sensor 67R configured to detect the number of revolutions and the rotation direction of the second traveling motor 36R. Therefore, based on the number of revolutions and the rotation direction of each of the first traveling motor 36L and the second traveling motor 36R, determination as to whether in a straight traveling state or a turn traveling state can be performed well.

Second Preferred Embodiment

In the first preferred embodiment described above, upon receiving a shift-up command (a command to shift to "second") or a shift-down command (a command to shift to "first"), the controller 60 performs shift shock reduction control that involves reducing the opening of the actuation valve 69 according to a straight traveling state or a turn traveling state of the machine body 2. However, the scope of the present disclosure is not limited to this example. In the working machine according to the second preferred embodiment, upon receiving a shift-up command (a command to shift to "second") or a shift-down command (a command to shift to "first"), the controller 60 performs shift shock reduction control that involves reducing the number of revolutions of the prime mover 32 according to a straight traveling state or a turn traveling state of the machine body 2.

That is, the second preferred embodiment is different from the first preferred embodiment in that the number of revolutions of the prime mover 32 is reduced instead of reducing the opening of the actuation valve 69, which has been disclosed in the first preferred embodiment. Therefore, in the second preferred embodiment, the point of difference from the first preferred embodiment will be described in detail.

The controller 60 sets an amount of reduction ΔF1 in the number of revolutions of the prime mover 32 according to a straight traveling state or a turn traveling state (a pivot turn, a spin turn, a large turn, a small turn) of the machine body 2 that has been determined by the determiner 70. For example, the controller 60 sets the amount of reduction ΔF1 in the number of revolutions of the prime mover 32 such that it becomes smaller in the order of a straight traveling state>a turn traveling state. In addition, for a turn traveling state, the controller 60 sets the amount of reduction ΔF1 in the number of revolutions of the prime mover 32 such that it becomes smaller in the order of, for example, a large turn>a pivot turn>a small turn>a spin turn.

The second preferred embodiment is the same as the first preferred embodiment in that, in the control map illustrated in FIG. 3C, an amount of reduction for a case where the traveling state is "straight traveling" and where the number of revolutions of the first, second traveling motor 36L, 36R is 200 rpm has been set as the amount of reduction ΔF1 in advance. For example, in a case where the traveling state is "straight traveling" and where the larger one of the number of revolutions of the first traveling motor 36L and the number of revolutions of the second traveling motor 36R is 200 rpm, the controller 60 decides a value obtained by multiplying the amount of reduction ΔF1 by the gain percentage (=100%) as the amount of reduction "ΔF1×1". In a case where the traveling state is "pivot turn" and where the larger one of the number of revolutions of the first traveling motor 36L and the number of revolutions of the second traveling motor 36R is 200 rpm, the controller 60 decides a value obtained by multiplying the amount of reduction ΔF1 by the gain percentage (=60%) as the amount of reduction "ΔF1×0.6". In a case where the traveling state is "spin turn" and where the larger one of the number of revolutions of the first traveling motor 36L and the number of revolutions of the second traveling motor 36R is 150 rpm, the controller 60 decides a value obtained by multiplying the amount of reduction ΔF1 by the gain percentage (=20%) as the amount of reduction "ΔF1×0.2".

First, shift shock reduction control at the time of shift-up operation will now be explained.

Figure 4:
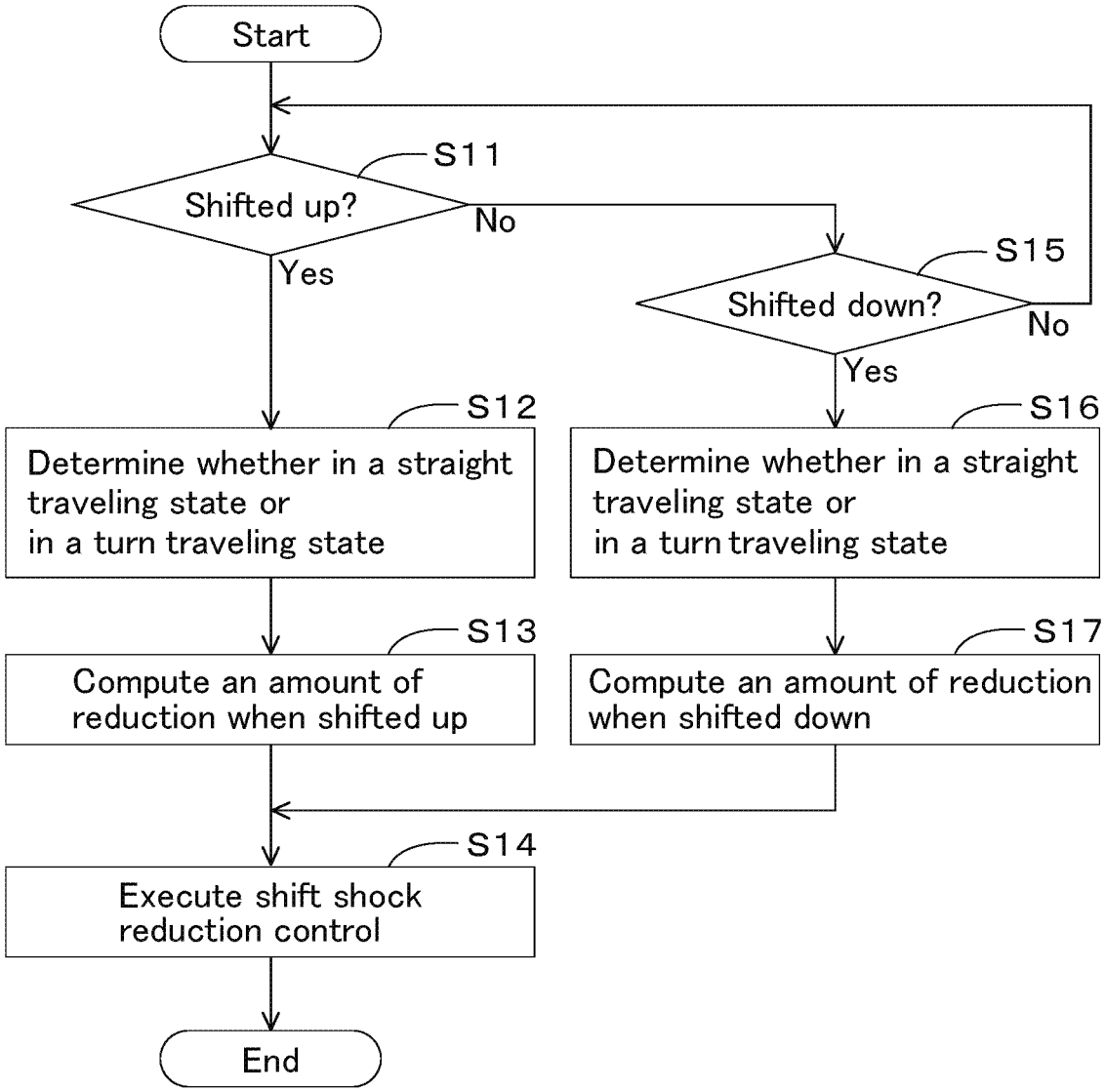
FIG. 4 is a flowchart illustrating shift shock reduction control.

In the second preferred embodiment, in S13 illustrated in FIG. 4, the controller 60 computes, by using the control map illustrated in FIG. 3C, the amount of reduction ΔF1 in the number of revolutions of the prime mover 32 at the time of shift-up operation (S13) according to the straight traveling state or the turn traveling state (a pivot turn, a spin turn, a large turn, a small turn) of the machine body 2 that has been determined by the determiner 70. Based on the computed amount of reduction ΔF1, the controller 60 performs shift shock reduction control (S14).

Figure 8:
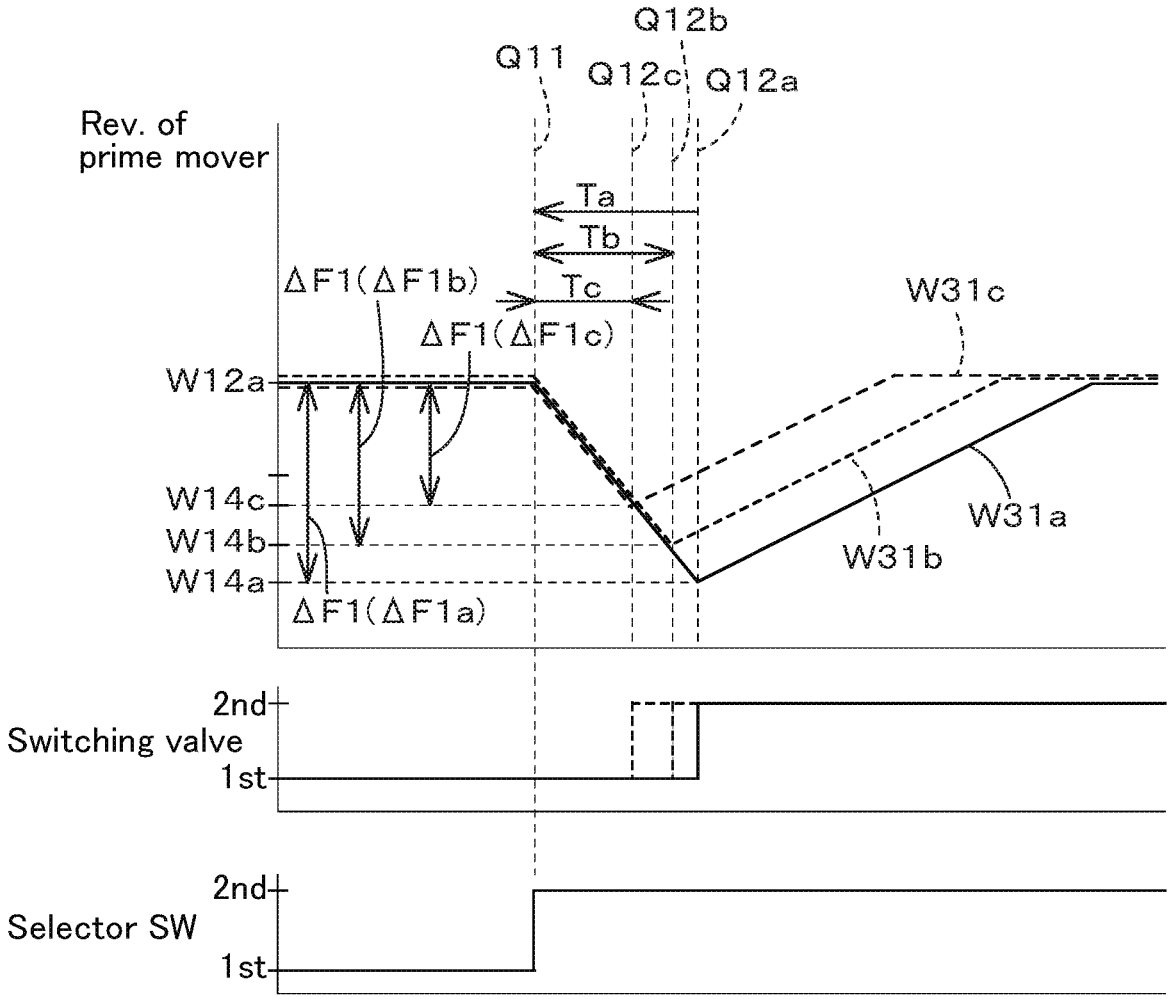
FIG. 8 is a diagram illustrating a relationship between the number of revolutions of a prime mover and the switching of a traveling motor in a case where the speed of the traveling motor is increased.

FIG. 8 is a diagram illustrating a relationship between the respective control values of three control signals for straight traveling, a pivot turn, and a spin turn (reduced values W14*a*, W14*b*, and W14*c*) and the switching of the traveling motor in a case where shift shock reduction control at the time of shift-up operation is performed. In FIG. 8, the reduced value W14*a* for straight traveling, the reduced value W14*b* for a pivot turn, and the reduced value W14*c* for a spin turn are shown for a case where the larger one of the number of revolutions of the first traveling motor 36L and the number of revolutions of the second traveling motor 36R is 200 rpm.

First, shift-up operation for a case where the machine body 2 is in a straight traveling state will be described in this paragraph. Let us assume that, at a point in time Q11, the selector switch 61 is operated, and the controller 60 acquires a shift-up command (a command to shift to "second") for switching from the first state (the first speed) to the second state (the second speed). Then, the determiner 70 determines that the machine body 2 is in a straight traveling state. Looking up the control map illustrated in FIG. 3C, the controller 60 identifies the gate percentage as (100%), which corresponds to the state of "straight traveling" at the number of revolutions of the motor of 200 rpm, and multiplies the amount of reduction ΔF1 by the gain percentage "1=100%" to compute an amount of reduction ΔF1*a* (=an amount of reduction "ΔF1×1"). As illustrated in FIG. 8, when the machine body 2 is in a straight traveling state, the controller 60 sets the amount of reduction ΔF1*a* at the point in time Q11.

Next, shift-up operation for a case where the machine body 2 is making a pivot turn will be described. Let us assume that, at the point in time Q11, the selector switch 61 is operated, and the controller 60 acquires a command to shift to "second". Then, the determiner 70 determines that the machine body 2 is making a pivot turn. Looking up the control map illustrated in FIG. 3C, the controller 60 identifies the gate percentage as (60%), which corresponds to the state of making a "pivot turn" at the number of revolutions of the motor of 200 rpm, and multiplies the amount of reduction ΔF1 by the gain percentage "0.6=60%" to compute an amount of reduction ΔF1*b* (=an amount of reduction "ΔF1×0.6"). As illustrated in FIG. 8, when the machine body 2 is making a pivot turn, the controller 60 sets the amount of reduction ΔF1*b* at the point in time Q11.

Next, shift-up operation for a case where the machine body 2 is making a spin turn will be described. Let us assume that, at the point in time Q11, the selector switch 61 is operated, and the controller 60 acquires a command to shift to "second". Then, the determiner 70 determines that the machine body 2 is making a spin turn. Looking up the control map illustrated in FIG. 3C, the controller 60 identifies the gate percentage as (30%), which corresponds to the state of making a "spin turn" at the number of revolutions of the motor of 200 rpm, and multiplies the amount of reduction ΔF1 by the gain percentage "0.3=30%" to compute an amount of reduction ΔF1*c* (=an amount of reduction "ΔF1×0.3"). As illustrated in FIG. 8, when the machine body 2 is making a spin turn, the controller 60 sets the amount of reduction ΔF1*c* at the point in time Q11.

Upon completing the setting of the amount of reduction ΔF1, the controller 60 sets, as the reduced value W14*a*, W14*b*, W14*c* in shift shock reduction control, a value obtained by subtracting the amount of reduction ΔF1 (ΔF1*a*, ΔF1*b*, ΔF1*c*) from a control value W12*a* of an "immediately-before-reduction" control signal. For example, when the machine body 2 is in a straight traveling state, the controller 60 sets, as the reduced value W14*a*, a value obtained by subtracting the amount of reduction ΔF1*a* from the "immediately-before-reduction" control value W12*a*. Alternatively, when the machine body 2 is making a pivot turn, the controller 60 sets, as the reduced value W14*b*, a value obtained by subtracting the amount of reduction ΔF1*b* from the "immediately-before-reduction" control value W12*a*. Alternatively, when the machine body 2 is making a spin turn, the controller 60 sets, as the reduced value W14*c*, a value obtained by subtracting the amount of reduction ΔF1*c* from the "immediately-before-reduction" control value W12*a*.

Upon completing the setting of the reduced value W14*a*, W14*b*, W14*c*, the controller 60 decreases the control value outputted to the prime mover 32 until reaching the reduced value W14*a*, W14*b*, W14*c*.

Specifically, at the point in time Q11, when the machine body 2 is in a straight traveling state, the controller 60 starts decreasing the control value toward the reduced value W14*a* as indicated by a line W31*a*. At a point in time Q12*a*, the control value reaches the reduced value W14*a* as indicated by the line W31*a*. Upon reaching the reduced value W14*a*, the controller 60 outputs a signal for solenoid energization of the traveling switching valve 34, thereby switching the traveling switching valve 34 (switching valve) from the first state (first speed) to the second state (second speed). After the point in time Q12*a*, the controller 60 causes the control value to return toward the "immediately-before-reduction" control value W12*a* as indicated by the line W31*a*.

Alternatively, at the point in time Q11, when the machine body 2 is making a pivot turn, the controller 60 starts decreasing the control value toward the reduced value W14*b* as indicated by a line W31*b*. At a point in time Q12*b*, the control value reaches the reduced value W14*b* as indicated by the line W31*b*. Upon reaching the reduced value W14*b*, the controller 60 outputs a signal for solenoid energization of the traveling switching valve 34, thereby switching the traveling switching valve 34 (switching valve) from the first state (first speed) to the second state (second speed). After the point in time Q12*b*, the controller 60 causes the control value to return toward the "immediately-before-reduction" control value W12*a* as indicated by the line W31*b*.

Alternatively, at the point in time Q11, when the machine body 2 is making a spin turn, the controller 60 starts decreasing the control value toward the reduced value W14*c* as indicated by a line W31*c*. At a point in time Q12*c*, the control value reaches the reduced value W14*c* as indicated by the line W31*c*. Upon reaching the reduced value W14*c*, the controller 60 outputs a signal for solenoid energization of the traveling switching valve 34, thereby switching the traveling switching valve 34 (switching valve) from the first state (first speed) to the second state (second speed). After the point in time Q12*c*, the controller 60 causes the control value to return toward the "immediately-before-reduction" control value W12*a* as indicated by the line W31*c*.

Let us focus on reduction intervals Ta, Tb, and Tc, which are from the point in time Q11, at which the decreasing of the control values of the control signals starts, to the points in time Q12*a*, Q12*b*, and Q12*c*, at which the decreasing of the control values of the control signals ends respectively, namely, at which the control values of the control signals reach the reduced values W14*a*, W14*b*, and W14*c* respectively. Focusing on the reduction intervals Ta, Tb, and Tc reveals that the controller 60 sets a first reduction rate of the control values to be constant. That is, the controller 60 sets a constant inclination for the lines W31*a*, W31*b*, and W31*c* in the reduction intervals Ta, Tb, and Tc.

In addition, as can be seen from the fact that the traveling switching valve 34 switches from the first state to the second state at the point in time Q12*a*, Q12*b*, Q12*c*, the controller 60 sets the timing of the switching of the traveling switching valve 34 from the first state to the second state to be different depending on whether the machine body 2 is in a straight traveling state, is making a pivot turn, or is making a spin turn.

Though neither of a case of a large turn and a case of a small turn is illustrated in FIG. 8, the controller 60 is able to set the amount of reduction ΔF1 for the case of a large turn and the case of a small turn in the same manner as above. For example, looking up the control map illustrated in FIG. 3C, the controller 60 identifies the gate percentage as (80%), which corresponds to a case where the machine body 2 is making a large turn at the number of revolutions of the motor of 200 rpm, and multiplies the amount of reduction ΔF1 by the gain percentage "0.8=80%" to compute an amount of reduction "ΔF1×0.8". Then, the controller 60 sets a value obtained by subtracting the amount of reduction "ΔF1×0.8" from the "immediately-before-reduction" control value W12*a* as the reduced value (an intermediate value between W14*a* and W14*b*). Alternatively, looking up the control map illustrated in FIG. 3C, the controller 60 identifies the gate percentage as (40%), which corresponds to a case where the machine body 2 is making a small turn at the number of revolutions of the motor of 200 rpm, and multiplies the amount of reduction ΔF1 by the gain percentage "0.4=40%" to compute an amount of reduction "ΔF1×0.4". Then, the controller 60 sets a value obtained by subtracting the amount of reduction "ΔF1×0.4" from the "immediately-before-reduction" control value W12*a* as the reduced value (an intermediate value between W14*b* and W14*c*).

Figure 9:
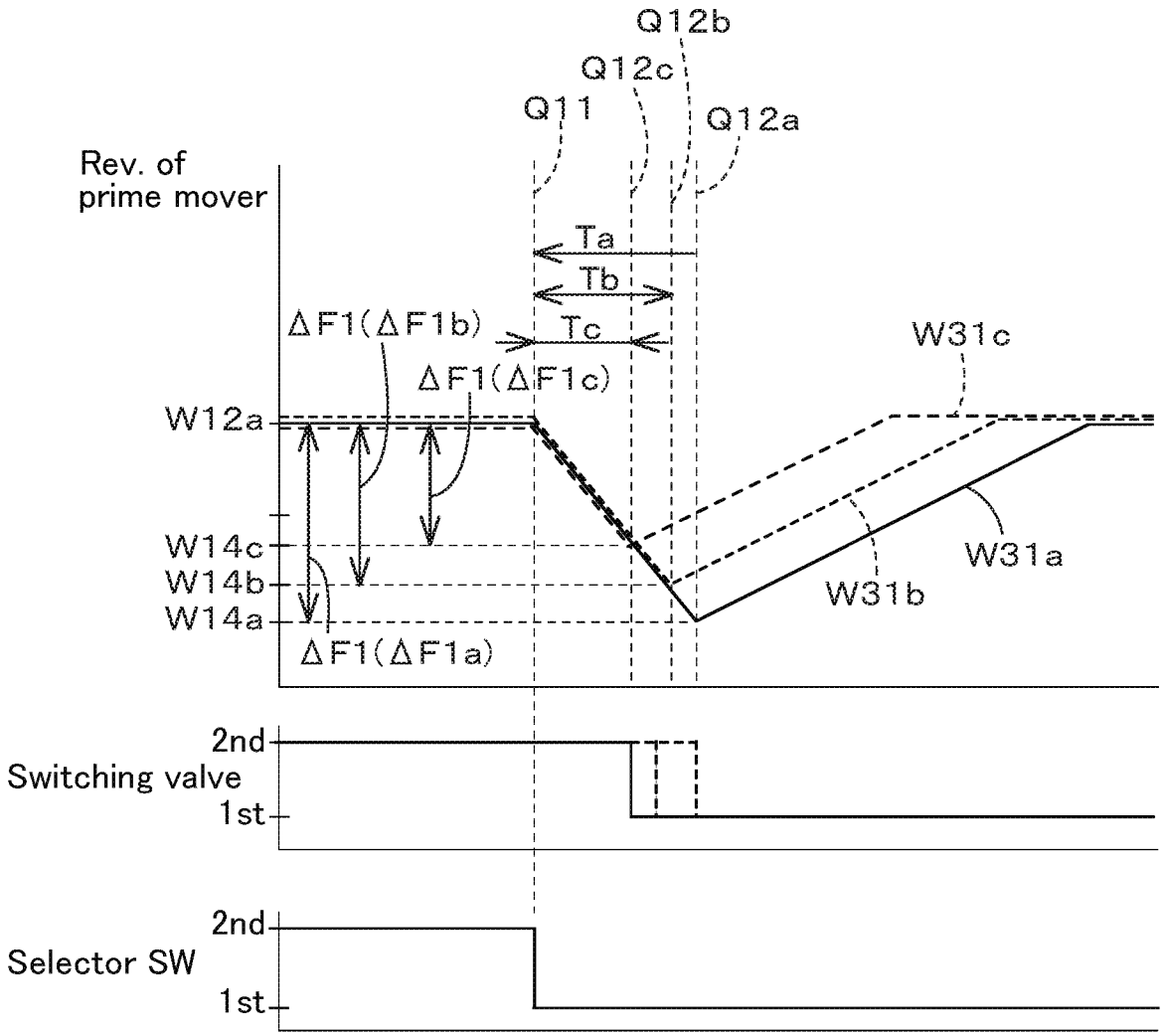
FIG. 9 is a diagram illustrating a relationship between the number of revolutions of a prime mover and the switching of a traveling motor in a case where the speed of the traveling motor is decreased.

FIG. 9 is a diagram illustrating a relationship between the respective control values of three control signals for straight traveling, a pivot turn, and a spin turn (reduced values W14*a*, W14*b*, and W14*c*) and the switching of the traveling motor in a case where shift shock reduction control at the time of shift-down operation is performed. In FIG. 9, the reduced value W14*a* for straight traveling, the reduced value W14*b* for a pivot turn, and the reduced value W14*c* for a spin turn are shown for a case where the larger one of the number of revolutions of the first traveling motor 36L and the number of revolutions of the second traveling motor 36R is 200 rpm.

First, shift-down operation for a case where the machine body 2 is in a straight traveling state will be described in this paragraph. Let us assume that, at a point in time Q11, the selector switch 61 is operated, and the controller 60 acquires a shift-down command (a command to shift to "first") for switching from the second state (the second speed) to the first state (the first speed). Then, the determiner 70 determines that the machine body 2 is in a straight traveling state. Looking up the control map illustrated in FIG. 3C, the controller 60 identifies the gate percentage as (100%), which corresponds to the state of "straight traveling" at the number of revolutions of the motor of 200 rpm, and multiplies the amount of reduction ΔF1 by the gain percentage "1=100%" to compute an amount of reduction ΔF1*a* (=an amount of reduction "ΔF1×1"). As illustrated in FIG. 9, when the machine body 2 is in a straight traveling state, the controller 60 sets the amount of reduction ΔF1*a* at the point in time Q11.

Next, shift-down operation for a case where the machine body 2 is making a pivot turn will be described. Let us assume that, at the point in time Q11, the selector switch 61 is operated, and the controller 60 acquires a command to shift to "first". Then, the determiner 70 determines that the machine body 2 is making a pivot turn. Looking up the control map illustrated in FIG. 3C, the controller 60 identifies the gate percentage as (60%), which corresponds to the state of making a "pivot turn" at the number of revolutions of the motor of 200 rpm, and multiplies the amount of reduction ΔF1 by the gain percentage "0.6=60%" to compute an amount of reduction ΔF1*b* (=an amount of reduction "ΔF1×0.6"). As illustrated in FIG. 9, when the machine body 2 is making a pivot turn, the controller 60 sets the amount of reduction ΔF1*b* at the point in time Q11.

Next, shift-down operation for a case where the machine body 2 is making a spin turn will be described. Let us assume that, at the point in time Q11, the selector switch 61 is operated, and the controller 60 acquires a command to shift to "second". Then, the determiner 70 determines that the machine body 2 is making a spin turn. Looking up the control map illustrated in FIG. 3C, the controller 60 identifies the gate percentage as (30%), which corresponds to the state of making a "spin turn" at the number of revolutions of the motor of 200 rpm, and multiplies the amount of reduction ΔF1 by the gain percentage "0.3=30%" to compute an amount of reduction ΔF1*c* (=an amount of reduction "ΔF1×0.3"). As illustrated in FIG. 9, when the machine body 2 is making a spin turn, the controller 60 sets the amount of reduction ΔF1*c* at the point in time Q11.

Upon completing the setting of the amount of reduction ΔF1, the controller 60 sets, as the reduced value W14*a*, W14*b*, W14*c* in shift shock reduction control, a value obtained by subtracting the amount of reduction ΔF1 (ΔF1*a*, ΔF1*b*, ΔF1*c*) from a control value W12*a* of an "immediately-before-reduction" control signal. For example, when the machine body 2 is in a straight traveling state, the controller 60 sets, as the reduced value W14*a*, a value obtained by subtracting the amount of reduction ΔF1*a* from the "immediately-before-reduction" control value W12*a*. Alternatively, when the machine body 2 is making a pivot turn, the controller 60 sets, as the reduced value W14*b*, a value obtained by subtracting the amount of reduction ΔF1*b* from the "immediately-before-reduction" control value W12*a*. Alternatively, when the machine body 2 is making a spin turn, the controller 60 sets, as the reduced value W14*c*, a value obtained by subtracting the amount of reduction ΔF1*c* from the "immediately-before-reduction" control value W12*a*.

Upon completing the setting of the reduced value W14*a*, W14*b*, W14*c*, the controller 60 decreases the control value outputted to the prime mover 32 until reaching the reduced value W14*a*, W14*b*, W14*c*.

Specifically, at the point in time Q11, when the machine body 2 is in a straight traveling state, the controller 60 starts decreasing the control value toward the reduced value W14*a* as indicated by a line W31*a*. At a point in time Q12*a*, the control value reaches the reduced value W14*a* as indicated by the line W31*a*. Upon reaching the reduced value W14*a*, the controller 60 outputs a signal for solenoid energization of the traveling switching valve 34, thereby switching the traveling switching valve 34 (switching valve) from the second state (second speed) to the first state (first speed). After the point in time Q12*a*, the controller 60 causes the control value to return toward the "immediately-before-reduction" control value W12*a* as indicated by the line W31*a*.

Alternatively, at the point in time Q11, when the machine body 2 is making a pivot turn, the controller 60 starts decreasing the control value toward the reduced value W14*b* as indicated by a line W31*b*. At a point in time Q12*b*, the control value reaches the reduced value W14*b* as indicated by the line W31*b*. Upon reaching the reduced value W14*b*, the controller 60 outputs a signal for solenoid energization of the traveling switching valve 34, thereby switching the traveling switching valve 34 (switching valve) from the second state (second speed) to the first state (first speed). After the point in time Q12*b*, the controller 60 causes the control value to return toward the "immediately-before-reduction" control value W12*a* as indicated by the line W31*b*.

Alternatively, at the point in time Q11, when the machine body 2 is making a spin turn, the controller 60 starts decreasing the control value toward the reduced value W14*c* as indicated by a line W31*c*. At a point in time Q12*c*, the control value reaches the reduced value W14*c* as indicated by the line W31*c*. Upon reaching the reduced value W14*c*, the controller 60 outputs a signal for solenoid energization of the traveling switching valve 34, thereby switching the traveling switching valve 34 (switching valve) from the second state (second speed) to the first state (first speed). After the point in time Q12*c*, the controller 60 causes the control value to return toward the "immediately-before-reduction" control value W12*a* as indicated by the line W31*c*.

Let us focus on reduction intervals Ta, Tb, and Tc, which are from the point in time Q11, at which the decreasing of the control values of the control signals starts, to the points in time Q12*a*, Q12*b*, and Q12*c*, at which the decreasing of the control values of the control signals ends respectively, namely, at which the control values of the control signals reach the reduced values W14*a*, W14*b*, and W14*c* respectively. Focusing on the reduction intervals Ta, Tb, and Tc reveals that the controller 60 sets a first reduction rate of the control values to be constant. That is, the controller 60 sets a constant inclination for the lines W31*a*, W31*b*, and W31*c* in the reduction intervals Ta, Tb, and Tc.

In addition, as can be seen from the fact that the traveling switching valve 34 switches from the second state to the first state at the point in time Q12*a*, Q12*b*, Q12*c*, the controller 60 sets the timing of the switching of the traveling switching valve 34 from the second state to the first state to be different depending on whether the machine body 2 is in a straight traveling state, is making a pivot turn, or is making a spin turn.

Though neither of a case of a large turn and a case of a small turn is illustrated in FIG. 9, the amount of reduction ΔF1 for the case of a large turn and the case of a small turn can be set in the same manner as above. For example, looking up the control map illustrated in FIG. 3C, the controller 60 identifies the gate percentage as (80%), which corresponds to a case where the machine body 2 is making a large turn at the number of revolutions of the motor of 200 rpm, and multiplies the amount of reduction ΔF1 by the gain percentage "0.8=80%" to compute an amount of reduction "ΔF1×0.8". Then, the controller 60 sets a value obtained by subtracting the amount of reduction "ΔF1×0.8" from the "immediately-before-reduction" control value W12*a* as the reduced value (an intermediate value between W14*a* and W14*b*). Alternatively, looking up the control map illustrated in FIG. 3C, the controller 60 identifies the gate percentage as (40%), which corresponds to a case where the machine body 2 is making a small turn at the number of revolutions of the motor of 200 rpm, and multiplies the amount of reduction ΔF1 by the gain percentage "0.4=40%" to compute an amount of reduction "ΔF1×0.4". Then, the controller 60 sets a value obtained by subtracting the amount of reduction "ΔF1×0.4" from the "immediately-before-reduction" control value W12*a* as the reduced value (an intermediate value between W14*b* and W14*c*).

In the working machine according to the second preferred embodiment described above, the controller 60 sets an amount of reduction in the number of revolutions of the prime mover 32 according to a straight traveling state or a turn traveling state of the machine body 2. Therefore, it is possible to set an appropriate reduced value for shift shock reduction control for each of a straight traveling state and a turn traveling state. Therefore, it is possible to perform shift shock reduction control appropriately not only when in a straight traveling state but also when in a turn traveling state.

The determiner 70 determines that the machine body 2 is in a straight traveling state (i) in a case where the rotation direction of the first traveling motor 36L is the same as the rotation direction of the second traveling motor 36R and, in addition, where the difference in the number of revolutions between the first traveling motor 36L and the second traveling motor 36R is zero or is less than a first difference having been determined in advance. The determiner 70 determines that the machine body 2 is making a pivot turn (ii) in a case where either one of the first traveling motor 36L and the second traveling motor 36R, not both, is rotating. The determiner 70 determines that the machine body 2 is making a spin turn (iii) in a case where the rotation direction of the first traveling motor 36L and the rotation direction of the second traveling motor 36R are the opposite of each other and, in addition, where the difference in the number of revolutions between the first traveling motor 36L and the second traveling motor 36R is zero or is less than the first difference. Therefore, the determiner 70 is able to perform accurate determination of a straight traveling state, and accurate determination of a pivot turn and a spin turn in a turn traveling state. The controller 60 sets an amount of reduction in the number of revolutions of the prime mover 32 according to a straight traveling state, a pivot turn, and a spin turn of the machine body 2. Therefore, it is possible to set an appropriate reduced value for shift shock reduction control for a straight traveling state, for a pivot turn, and for a spin turn. Therefore, it is possible to perform shift shock reduction control appropriately not only for a case of a straight traveling state but also for a case of plural kinds of a turn traveling state, specifically, a pivot turn and a spin turn.

The determiner 70 determines that the machine body 2 is making a large turn (iv) in a case where the rotation direction of the first traveling motor 36L is the same as the rotation direction of the second traveling motor 36R and, in addition, where the difference in the number of revolutions between the first traveling motor 36L and the second traveling motor 36R is greater than the first difference. The determiner 70 determines that the machine body 2 is making a small turn (v) in a case where the rotation direction of the first traveling motor 36L and the rotation direction of the second traveling motor 36R are the opposite of each other and, in addition, where the difference in the number of revolutions between the first traveling motor 36L and the second traveling motor 36R is greater than the first difference. Therefore, the determiner 70 is able to perform accurate determination of a large turn and a small turn in a turn traveling state. The controller 60 sets an amount of reduction in the number of revolutions of the prime mover 32 according to a large turn and a small turn of the machine body 2. Therefore, it is possible to set an appropriate reduced value for shift shock reduction control for a large turn and for a small turn. Therefore, it is possible to perform shift shock reduction control appropriately for a case of plural kinds of a turn traveling state, specifically, a large turn and a small turn.

The controller 60 sets an amount of reduction in the number of revolutions of the prime mover 32 such that it becomes smaller in the order of a straight traveling state>a large turn>a pivot turn>a small turn>a spin turn. Therefore, it is possible to set an appropriate reduced value for shift shock reduction control for a straight traveling state, for a large turn, for a pivot turn, for a small turn, and for a spin turn. Therefore, it is possible to perform shift shock reduction control appropriately for a case of a straight traveling state and for a case of plural kinds of a turn traveling state (a large turn, a pivot turn, a small turn, a spin turn).

The controller 60 has a control map in which, for each of a straight traveling state and a turn traveling state, an amount of reduction in the number of revolutions of the prime mover 32 has been set in advance for each of a plurality of number-of-revolutions segments obtained by performing multiple-range segmentation of the number of revolutions of the first, second traveling motor 36L, 36R. Therefore, for each of a straight traveling state and a turn traveling state, it is possible to control an amount of reduction in the number of revolutions of the prime mover 32 quickly by using a control map in which the amount of reduction in the number of revolutions of the prime mover 32 has been set in advance for each of the plurality of number-of-revolutions segments.

In the first and second preferred embodiments described above, the controller 60 sets an amount of reduction (an amount of reduction in opening of the actuation valve 69 or an amount of reduction in the number of revolutions of the prime mover 32). However, as illustrated in FIGS. 10A, 10B, and 11, the controller 60 may set various kinds of parameters.

Figure 10A:
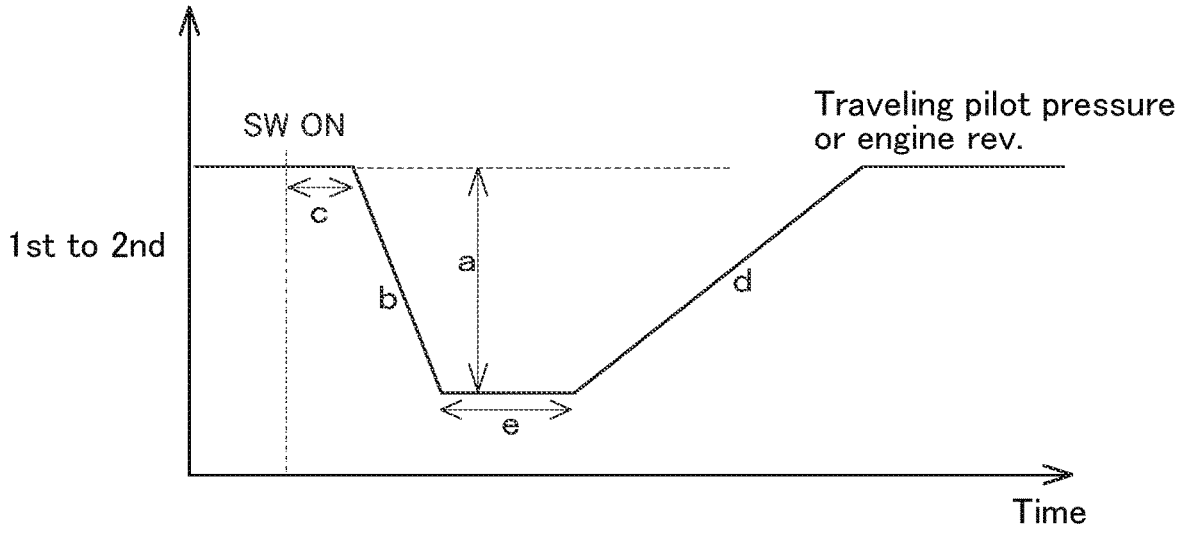
FIG. 10A is a graph showing parameters of reduction for a case where the speed of the traveling motor is increased.
Figure 10B:
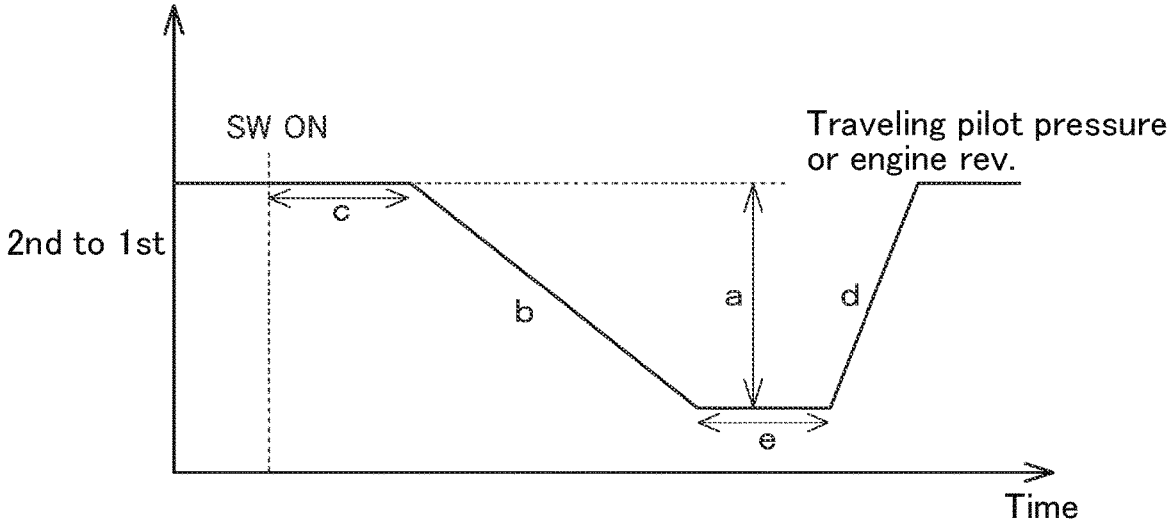
FIG. 10B is a graph showing parameters of reduction for a case where the speed of the traveling motor is decreased.

Upon receiving a shift-up command, the controller 60 performs shift shock reduction control along a control line illustrated in FIG. 10A (a parameter line indicating changes in reduction in opening of the actuation valve 69 or changes in reduction in the number of revolutions of the prime mover 32). Upon receiving a shift-down command, the controller 60 performs shift shock reduction control along a control line illustrated in FIG. 10B (a parameter line indicating changes in reduction in opening of the actuation valve 69 or changes in reduction in the number of revolutions of the prime mover 32).

A data table illustrated in FIG. 11 includes "traveling state of the machine body 2", "vehicle speed of the machine body 2" (for example, the number of revolutions of the first, second traveling motor 36L, 36R), and "parameter map". The parameter map includes, as various kinds of parameters, "reduction amount a", "reduction rate b", "delay time c", "return rate d", and "time before starting to return e".

For example, as illustrated in FIG. 11, in a case where the result of determination performed by the determiner 70 is "straight traveling" and where the number of revolutions of the first, second traveling motor 36L, 36R that has been acquired by the acquirer 67 is V1 (for example, 200 rpm), the controller 60 performs shift shock reduction control by setting the various kinds of parameters in the parameter map as follows: "reduction amount a1", "reduction rate b1", "delay time c1", "return rate d1", and "time before starting to return e1". As another example, as illustrated in FIG. 11, in a case where the result of determination performed by the determiner 70 is "spin turn" and where the number of revolutions of the first, second traveling motor 36L, 36R that has been acquired by the acquirer 67 is V1 (for example, 200 rpm), the controller 60 performs shift shock reduction control by setting the various kinds of parameters in the parameter map as follows: "reduction amount a5", "reduction rate b5", "delay time c5", "return rate d5", and "time before starting to return e5".

Third Preferred Embodiment

In the first and second preferred embodiments described above, the traveling manipulator 54 is a hydraulic-type device configured to change pilot pressure acting on the traveling pumps (the first traveling pump 53L and the second traveling pump 53R) by means of the operation valves 55.

However, the traveling manipulator 54 may be an electric-type device. In a working machine according to a third preferred embodiment, the traveling manipulator 54 illustrated in FIG. 12 operates electrically.

Figure 12:
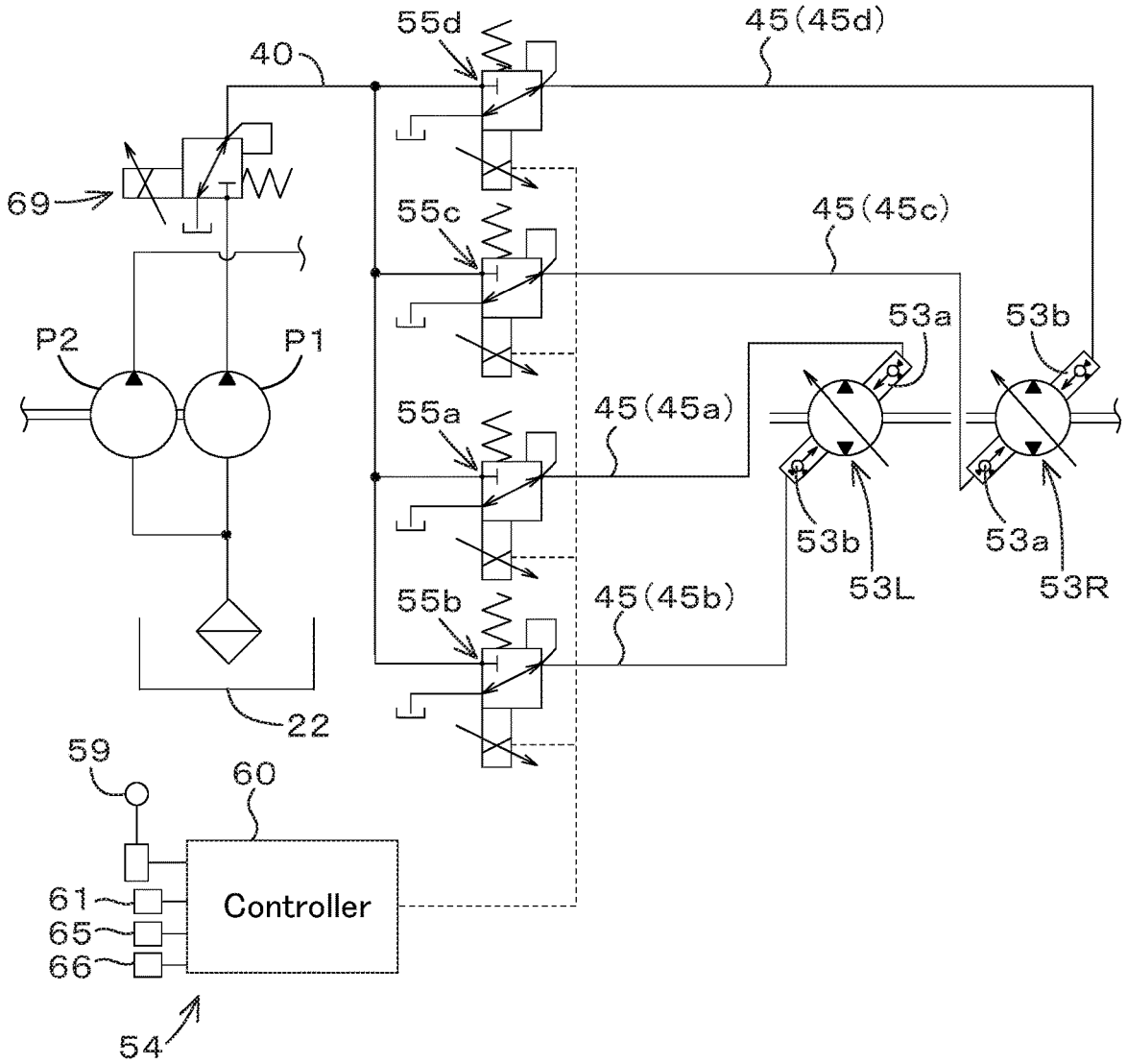
FIG. 12 is a diagram illustrating a modified configuration in which a hydraulic-type manipulator is replaced with an electric-type manipulator such as a joystick.

As illustrated in FIG. 12, the traveling manipulator 54 includes the operation member 59 configured to be swung in the left-right direction (the machine-body width direction) or the front-rear direction selectively and the operation valves 55 (operation valves 55A, 55B, 55C, and 55D) that are proportional solenoid valves. An operation detection sensor configured to detect an operation amount and an operation direction of the operation member 59 is connected to the controller 60. Based on the operation amount and the operation direction detected by the operation detection sensor, the controller 60 controls the operation valves 55 (operation valves 55A, 55B, 55C, and 55D).

When the operation member 59 is operated forward (in the direction indicated by the arrow A1; see FIG. 1), control signals are outputted to the operation valves 55A and 55C to cause the swash plates of the first traveling pump 53L and the second traveling pump 53R to tilt in the normal (forward) direction.

When the operation member 59 is operated rearward (in the direction indicated by the arrow A2; see FIG. 1), control signals are outputted to the operation valves 55B and 55D to cause the swash plates of the first traveling pump 53L and the second traveling pump 53R to tilt in the reverse (rearward) direction.

When the operation member 59 is operated rightward (in the direction indicated by the arrow A3; see FIG. 1), control signals are outputted to the operation valves 55A and 55D to cause the swash plate of the first traveling pump 53L to tilt in the normal direction and cause the swash plate of the second traveling pump 53R to tilt in the reverse direction.

When the operation member 59 is operated leftward (in the direction indicated by the arrow A4; see FIG. 1), control signals are outputted to the operation valves 55B and 55C to cause the swash plate of the first traveling pump 53L to tilt in the reverse direction and cause the swash plate of the second traveling pump 53R to tilt in the normal direction.

The controller 60 may perform shift shock reduction control of changing the opening of the operation valves 55A to 55D to change the swash-plate angles of the first traveling pump 53L and the second traveling pump 53R by changing the control values of control signals to the operation valves 55A to 55D according to a straight traveling state or a turn traveling state of the machine body 2, thereby reducing an amount of hydraulic fluid supply from the first traveling pump 53L and the second traveling pump 53R to the first traveling motor 36L and the second traveling motor 36R.

Fourth Preferred Embodiment

Figure 13:
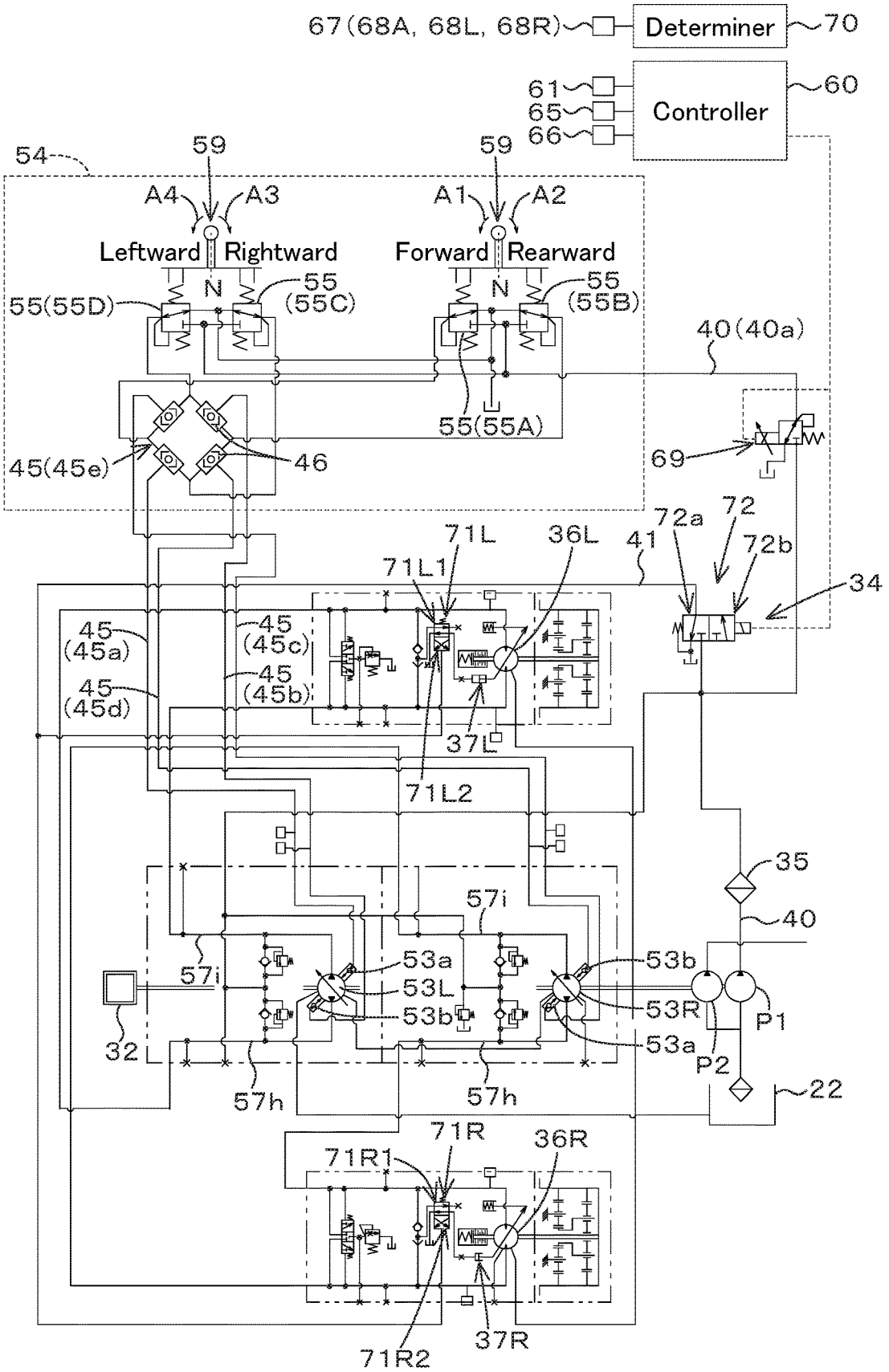
FIG. 13 is a diagram illustrating a hydraulic system (hydraulic circuit) of a working machine according to a fourth preferred embodiment.

In the first to third preferred embodiments described above, the acquirer 67 includes the rotation detection sensors 67L and 67R, and, based on the number of revolutions and the rotation direction of the first traveling motor 36L that has been detected by the rotation detection sensor 67L and the number of revolutions and the rotation direction of the second traveling motor 36R that has been detected by the rotation detection sensor 67R, the determiner 70 determines whether the machine body 2 is in a straight traveling state or in a turn traveling state. However, the scope of the present disclosure is not limited to this example. The working machine may have a configuration according to a fourth preferred embodiment illustrated in FIG. 13. As illustrated in FIG. 13, the acquirer 67 includes number-of-revolutions detection sensors 68L and 68R configured to detect the number of revolutions of the first traveling motor 36L and the number of revolutions of the second traveling motor 36R and an operation direction detection sensor 68A configured to detect an operation direction of the operation member 59. Based on the operation direction of the operation member 59 that has been detected by the operation direction detection sensor 68A, the determiner 70 determines whether the machine body 2 is in a straight traveling state or in a turn traveling state. The operation direction detection sensor 68A is capable of detecting the operation direction of the operation member 59, in which it is swung, that is, the direction indicated by each arrow A1-A7 in FIG. 2. In accordance with the operation direction of the operation member 59 that has been detected by the operation direction detection sensor 68A (namely, the direction indicated by each arrow A1-A7 in FIG. 2), the determiner 70 determines whether the machine body 2 is in a straight traveling state (straight forward traveling, straight rearward traveling) or in a turn traveling state (a large turn, a pivot turn, a small turn, a spin turn). The number-of-revolutions detection sensor 68L, 68R outputs the detected number of revolutions of the first, second traveling motor 36L, 36R to the controller 60. The controller 60 performs shift shock reduction control of reducing an amount of hydraulic fluid supply from the first traveling pump 53L and the second traveling pump 53R to the first traveling motor 36L and the second traveling motor 36R according to a straight traveling state or a turn traveling state (a pivot turn, a spin turn, a large turn, a small turn) of the machine body 2 that has been determined by the determiner 70 and by using the number of revolutions of each of the first traveling motor 36L and the second traveling motor 36R. Specifically, the controller 60 performs shift shock reduction control of reducing an amount of hydraulic fluid supply from the first traveling pump 53L and the second traveling pump 53R to the first traveling motor 36L and the second traveling motor 36R by setting an amount of reduction in opening of the actuation valve 69 as disclosed in the first preferred embodiment, by setting an amount of reduction in the number of revolutions of the prime mover 32 as disclosed in the second preferred embodiment, or by setting the control values of control signals to the operation valves 55A to 55D as disclosed in the third preferred embodiment.

The fourth preferred embodiment produces the same effects as those of the first to third preferred embodiments.

The controller 60 may be configured to set a manual shift mode or an automatic shift mode and set a diminution of reducing an amount of hydraulic fluid supply from the first traveling pump 53L and the second traveling pump 53R to the first traveling motor 36L and the second traveling motor 36R in the automatic shift mode to be greater than a diminution of reducing the amount of supply in the manual shift mode. For example, the operator operates a switch for making shift mode settings to output the manual shift mode or the automatic shift mode to the controller 60. With this configuration, it is possible to reduce a shift shock more when in the automatic shift mode than in the manual shift mode; therefore, the operator will not perceive shifting or is less likely to perceive shifting in the automatic shift mode, thereby realizing smooth automatic shifting. In addition, the operator is able to feel a part of a shift shock in manual shifting and thus obtain an operational feeling manually.

The content of the control map according to each of the foregoing preferred embodiments is not limited to that of FIG. 3C. For example, an amount of reduction in opening of the actuation valve 69 when in a straight traveling state may be smaller than when in a turn traveling state. An amount of reduction in opening of the actuation valve 69 may be set to become smaller in any arbitrary order of "large turn", "pivot turn", "small turn", and "spin turn". Therefore, the relationship between the number of revolutions of the motor and the gain percentage is not limited to the relationship illustrated in FIG. 3D.

In the control map illustrated in FIG. 3C, numerical data for all of "straight traveling", "large turn", "pivot turn", "small turn", and "spin turn" are pre-stored. However, the scope of the present disclosure is not limited to this example. For example, the control map may pre-store data for "straight traveling", "pivot turn", and "spin turn" only, without data for "large turn" and "small turn". In this case, the controller 60 may compute an amount of reduction for "large turn" by linear interpolation using the data for "straight traveling" and the data for "pivot turn" and compute an amount of reduction for "small turn" by linear interpolation using the data for "pivot turn" and the data for "spin turn". Therefore, the relationship between the number of revolutions of the motor and the gain percentage is not limited to the relationship illustrated in FIG. 3D.

In each of the foregoing preferred embodiments and modification examples, etc., the determiner 70 is a device, etc. different from the controller 60. However, the controller 60 may have the function of the determiner 70.

The traveling switching valve 34 may be any valve as long as it is switchable between the first state, in which it sets the rotation speed of the traveling motor (the first, second traveling motor 36L, 36R) to the first speed, and the second state, in which it sets the rotation speed of the traveling motor (the first, second traveling motor 36L, 36R) to the second speed. The traveling switching valve 34 may be a proportional valve different from a direction switching valve.

The traveling motor may be a motor that has "neutral" between the first speed and the second speed.

The traveling motor (the first, second traveling motor 36L, 36R) may be an axial piston motor or a radial piston motor. When the traveling motor is a radial piston motor, it is possible to perform switching to the first speed by an increase in motor displacement, and to the second speed by a decrease in motor displacement.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine, comprising:

a prime mover;

a machine body in which the prime mover is provided;

a left traveling device provided on a left side of the machine body;

a right traveling device provided on a right side of the machine body;

a left traveling pump operable by power of the prime mover to deliver a hydraulic fluid;

a right traveling pump operable by power of the prime mover to deliver a hydraulic fluid;

a left traveling motor to rotate in a normal or reverse direction with the hydraulic fluid delivered by the left traveling pump, and to transmit power to the left traveling device;

a right traveling motor to rotate in a normal or reverse direction with the hydraulic fluid delivered by the right traveling pump, and to transmit power to the right traveling device;

an acquirer to acquire a number of revolutions and a rotation direction of each of the left traveling motor and the right traveling motor;

a determiner to, based on the acquired number of revolutions and the acquired rotation direction of each of the left traveling motor and the right traveling motor, determine whether the machine body is in a straight traveling state or in a turn traveling state;

a traveling switching valve to switch between a first state allowing a rotation speed of the left traveling motor and a rotation speed of the right traveling motor to increase up to a first maximum speed, and a second state allowing the rotation speed of the left traveling motor and the rotation speed of the right traveling motor to increase up to a second maximum speed higher than the first maximum speed;

a traveling manipulator including an operation valve to change hydraulic fluid pressure acting on the left traveling pump and the right traveling pump in response to operation of an operation member; and a controller configured or programmed to reduce an amount of hydraulic fluid supply from the left traveling pump and the right traveling pump to the left traveling motor and the right traveling motor according to the straight traveling state or the turn traveling state of the machine body in a case of switching from the first state to the second state or switching from the second state to the first state.

2. The working machine according to claim 1, wherein the controller is configured or programmed to perform shift shock reduction control of reducing the amount of hydraulic fluid supply to the left traveling motor and the right traveling motor by reducing traveling pilot pressure, which is hydraulic fluid pressure acting on the left traveling pump and the right traveling pump, according to the straight traveling state or the turn traveling state of the machine body in the case of switching from the first state to the second state or switching from the second state to the first state.

3. The working machine according to claim 2, wherein the determiner is configured to determine a pivot turn and a spin turn in the turn traveling state, the determiner is configured to determine that the machine body is in the straight traveling state in a case where the rotation direction of the left traveling motor is same as the rotation direction of the right traveling motor and, in addition, where a difference in the number of revolutions between the left traveling motor and the right traveling motor is zero or is less than a first difference, determine that the machine body is making the pivot turn in a case where either the left traveling motor only or the right traveling motor only is rotating, and determine that the machine body is making the spin turn in a case where the rotation direction of the left traveling motor and the rotation direction of the right traveling motor are opposite of each other and, in addition, where the difference in the number of revolutions between the left traveling motor and the right traveling motor is zero or is less than the first difference, and the controller is configured or programmed to reduce the amount of hydraulic fluid supply to the left traveling motor and the right traveling motor by reducing the traveling pilot pressure according to the straight traveling state, the pivot turn, and the spin turn of the machine body.

4. The working machine according to claim 3, wherein the determiner is configured to determine a large turn and a small turn in the turn traveling state, the determiner is configured to determine that the machine body is making the large turn in a case where the rotation direction of the left traveling motor is same as the rotation direction of the right traveling motor and, in addition, where a difference in the number of revolutions between the left traveling motor and the right traveling motor is greater than the first difference, and determine that the machine body is making the small turn in a case where the rotation direction of the left traveling motor and the rotation direction of the right traveling motor are opposite of each other and, in addition, where the difference in the number of revolutions between the left traveling motor and the right traveling motor is greater than the first difference, and the controller is configured or programmed to reduce the amount of hydraulic fluid supply to the left traveling motor and the right traveling motor by reducing the traveling pilot pressure according to the large turn and the small turn of the machine body.

5. The working machine according to claim 4, wherein the controller is configured or programmed to set an amount of reduction in the traveling pilot pressure in such a way as to become smaller in an order of the straight traveling state, the large turn, the pivot turn, the small turn, and the spin turn.

6. The working machine according to claim 5, wherein the controller has a control map in which, for each of the straight traveling state and the turn traveling state, an amount of reduction in the traveling pilot pressure has been set in advance for each of a plurality of number-of-revolutions segments obtained by performing multiple-range segmentation of the number of revolutions of the left traveling motor and the number of revolutions of the right traveling motor.

7. The working machine according to claim 4, wherein the controller has a control map in which, for each of the straight traveling state and the turn traveling state, an amount of reduction in the traveling pilot pressure has been set in advance for each of a plurality of number-of-revolutions segments obtained by performing multiple-range segmentation of the number of revolutions of the left traveling motor and the number of revolutions of the right traveling motor.

8. The working machine according to claim 3, wherein the controller has a control map in which, for each of the straight traveling state and the turn traveling state, an amount of reduction in the traveling pilot pressure has been set in advance for each of a plurality of number-of-revolutions segments obtained by performing multiple-range segmentation of the number of revolutions of the left traveling motor and the number of revolutions of the right traveling motor.

9. The working machine according to claim 2, wherein the acquirer is a rotation detection sensor configured to detect the number of revolutions and the rotation direction of each of the left traveling motor and the right traveling motor.

10. The working machine according to claim 2, wherein the acquirer includes a number-of-revolutions detection sensor configured to detect the number of revolutions of each of the left traveling motor and the right traveling motor and an operation direction detection sensor configured to detect an operation direction of the operation member, and the determiner is configured to, based on the detected operation direction of the operation member, determine whether the machine body is in the straight traveling state or in the turn traveling state.

11. The working machine according to claim 1, wherein the controller is configured or programmed to perform shift shock reduction control of reducing a number of revolutions of the prime mover by outputting, to the prime mover, a control signal in which an amount of reduction in the number of revolutions of the prime mover is set, according to the straight traveling state or the turn traveling state of the machine body in the case of switching from the first state to the second state or switching from the second state to the first state.

12. The working machine according to claim 11, wherein the determiner is configured to determine a pivot turn and a spin turn in the turn traveling state, the determiner is configured to determine that the machine body is in the straight traveling state in a case where the rotation direction of the left traveling motor is same as the rotation direction of the right traveling motor and, in addition, where a difference in the number of revolutions between the left traveling motor and the right traveling motor is zero or is less than a first difference, determine that the machine body is making the pivot turn in a case where either the left traveling motor only or the right traveling motor only is rotating, and determine that the machine body is making the spin turn in a case where the rotation direction of the left traveling motor and the rotation direction of the right traveling motor are opposite of each other and, in addition, where the difference in the number of revolutions between the left traveling motor and the right traveling motor is zero or is less than the first difference, and the controller is configured or programmed to set the amount of reduction in the number of revolutions of the prime mover according to the straight traveling state, the pivot turn, and the spin turn of the machine body.

13. The working machine according to claim 12, wherein the determiner is configured to determine a large turn and a small turn in the turn traveling state, the determiner is configured to determine that the machine body is making the large turn in a case where the rotation direction of the left traveling motor is same as the rotation direction of the right traveling motor and, in addition, where a difference in the number of revolutions between the left traveling motor and the right traveling motor is greater than the first difference, and determine that the machine body is making the small turn in a case where the rotation direction of the left traveling motor and the rotation direction of the right traveling motor are opposite of each other and, in addition, where the difference in the number of revolutions between the left traveling motor and the right traveling motor is greater than the first difference, and the controller is configured or programmed to set the amount of reduction in the number of revolutions of the prime mover according to the large turn and the small turn of the machine body.

14. The working machine according to claim 13, wherein the controller is configured or programmed to set the amount of reduction in the number of revolutions of the prime mover in such a way as to become smaller in an order of the straight traveling state, the large turn, the pivot turn, the small turn, and the spin turn.

15. The working machine according to claim 14, wherein the controller has a control map in which, for each of the straight traveling state and the turn traveling state, the amount of reduction in the number of revolutions of the prime mover has been set in advance for each of a plurality of number-of-revolutions segments obtained by performing multiple-range segmentation of the number of revolutions of the left traveling motor and the number of revolutions of the right traveling motor.

16. The working machine according to claim 13, wherein the controller has a control map in which, for each of the straight traveling state and the turn traveling state, the amount of reduction in the number of revolutions of the prime mover has been set in advance for each of a plurality of number-of-revolutions segments obtained by performing multiple-range segmentation of the number of revolutions of the left traveling motor and the number of revolutions of the right traveling motor.

17. The working machine according to claim 12, wherein the controller has a control map in which, for each of the straight traveling state and the turn traveling state, the amount of reduction in the number of revolutions of the prime mover has been set in advance for each of a plurality of number-of-revolutions segments obtained by performing multiple-range segmentation of the number of revolutions of the left traveling motor and the number of revolutions of the right traveling motor.

18. The working machine according to claim 1, wherein the acquirer is a rotation detection sensor configured to detect the number of revolutions and the rotation direction of each of the left traveling motor and the right traveling motor.

19. The working machine according to claim 1, wherein the acquirer includes a number-of-revolutions detection sensor configured to detect the number of revolutions of each of the left traveling motor and the right traveling motor and an operation direction detection sensor configured to detect an operation direction of the operation member, and the determiner is configured to, based on the detected operation direction of the operation member, determine whether the machine body is in the straight traveling state or in the turn traveling state.

20. The working machine according to claim 1, wherein the controller is configured or programmed to set a manual shift mode or an automatic shift mode and set a diminution of reducing an amount of supply to the operation valve in the automatic shift mode to be greater than a diminution of reducing the amount of supply in the manual shift mode.

* * * * *